US010890042B2

(12) United States Patent
Segura et al.

(10) Patent No.: US 10,890,042 B2
(45) Date of Patent: Jan. 12, 2021

(54) SECTION MILL AND METHOD FOR ABANDONING A WELLBORE

(71) Applicant: Weatherford Technology Holdings, LLC, Houston, TX (US)

(72) Inventors: Richard J. Segura, Broussard, LA (US); Thomas F. Bailey, Abilene, TX (US); David J. Brunnert, Cypress, TX (US); Ram K. Bansal, Houston, TX (US); Andrew Antoine, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 153 days.

(21) Appl. No.: 16/025,870

(22) Filed: Jul. 2, 2018

(65) Prior Publication Data

US 2018/0320467 A1 Nov. 8, 2018

Related U.S. Application Data

(60) Continuation of application No. 14/677,002, filed on Apr. 2, 2015, now Pat. No. 10,012,048, which is a (Continued)

(51) Int. Cl.
*E21B 10/32* (2006.01)
*E21B 29/00* (2006.01)

(52) U.S. Cl.
CPC ..... *E21B 29/005* (2013.01); *E21B 29/002* (2013.01)

(58) Field of Classification Search
CPC .... E21B 10/322; E21B 29/005; E21B 29/002; E21B 10/32; E21B 29/06
See application file for complete search history.

(56) References Cited

U.S. PATENT DOCUMENTS 1,801,482 A 4/1931 Boynton
1,844,370 A * 2/1932 Santiago ..... E21B 10/32 175/283

(Continued)

FOREIGN PATENT DOCUMENTS

EP 0385673 A1 9/1990
EP 0916803 A2 5/1999

(Continued)

OTHER PUBLICATIONS

PCT International Search Report and Written Opinion dated May 18, 2011, International Application No. PCT/US2011/028430.

(Continued)

*Primary Examiner* — Kipp C Wallace
(74) *Attorney, Agent, or Firm* — Patterson & Sheridan, LLP

(57) ABSTRACT

A mill for use in a wellbore includes a tubular housing having a bore therethrough, a plurality of pockets formed in a wall thereof, and a blade disposed in each pocket. Each blade includes a body having a first side opposite a second side, wherein the first side faces in a direction of rotation of the mill. The blade also includes a blade portion disposed on the first side of the body, wherein the blade portion has a first cutting face stepped relative to a second cutting face. Each blade is movable between a retracted position and an extended position, wherein a portion of the first side and the second side protrude from the housing in the extended position.

16 Claims, 17 Drawing Sheets

Related U.S. Application Data division of application No. 13/047,658, filed on Mar. 14, 2011, now Pat. No. 9,022,117.

(60) Provisional application No. 61/383,627, filed on Sep. 16, 2010, provisional application No. 61/313,956, filed on Mar. 15, 2010.

(56) References Cited

U.S. PATENT DOCUMENTS 1,867,289 A 7/1932 Ventresca
2,481,637 A 9/1949 Yancey
2,572,997 A 10/1951 Edwards
2,735,485 A 2/1956 Metcalf, Jr.
2,761,196 A 9/1956 Graves et al.
2,846,193 A 8/1958 Chadderdon
2,899,000 A 8/1959 Medders et al.
3,110,084 A 11/1963 Kinzbach
3,283,405 A * 11/1966 Braswell ..... E21B 29/005 30/103
3,331,439 A * 7/1967 Sanford ..... E21B 29/005 166/55.8
3,351,134 A 11/1967 Kammerer
3,396,795 A 8/1968 Venghiattis
3,419,077 A 12/1968 Sanford
4,284,154 A 8/1981 England
4,431,065 A 2/1984 Andrews
4,565,252 A 1/1986 Campbell et al.
4,710,074 A 12/1987 Springer
4,889,197 A 12/1989 Boe
4,938,291 A 7/1990 Lynde et al.
5,012,863 A * 5/1991 Springer ..... E21B 10/46 166/55.7
5,027,914 A * 7/1991 Wilson ..... E21B 10/26 166/55.6
5,035,293 A 7/1991 Rives
5,036,921 A 8/1991 Pittard et al.
5,058,666 A 10/1991 Lynde et al.
5,060,738 A 10/1991 Pittard et al.
5,074,355 A 12/1991 Lennon
5,150,755 A 9/1992 Cassel et al.
5,242,017 A * 9/1993 Hailey ..... E21B 10/322 166/55.8
5,318,137 A 6/1994 Johnson et al.
5,318,138 A 6/1994 Dewey et al.
5,332,048 A 7/1994 Underwood et al.
5,341,888 A * 8/1994 Deschutter ..... E21B 10/322 175/323
5,373,900 A 12/1994 Lynde et al.
5,392,858 A 2/1995 Peters et al.
5,447,207 A 9/1995 Jones
5,532,048 A 7/1996 Klocek et al.
5,560,440 A 10/1996 Tibbitts
5,582,260 A 12/1996 Murer et al.
5,620,051 A 4/1997 Carter et al.
5,771,942 A 6/1998 Bunger
5,771,972 A 6/1998 Dewey et al.
5,887,668 A 3/1999 Haugen et al.
5,899,268 A 5/1999 Lynde et al.
5,908,071 A * 6/1999 Hutchinson ..... E21B 29/00 166/55.6
5,979,571 A 11/1999 Scott et al.
6,009,961 A 1/2000 Pietrobelli et al.
6,125,929 A * 10/2000 Davis ..... E21B 29/005 166/55.7
6,155,349 A 12/2000 Robertson et al.
6,202,752 B1 3/2001 Kuck et al.
6,206,111 B1 3/2001 Nistor
6,357,528 B1 3/2002 Davis et al.
6,378,632 B1 4/2002 Dewey et al.
6,401,821 B1 6/2002 Kennedy et al.
6,568,492 B2 5/2003 Thigpen et al.
6,612,383 B2 9/2003 Desai et al.
6,679,328 B2 1/2004 Davis et al.
6,732,817 B2 5/2004 Dewey et al.
6,920,923 B1 7/2005 Pietrobelli et al.
7,143,848 B2 12/2006 Armell
7,178,609 B2 2/2007 Hart et al.
7,314,099 B2 1/2008 Dewey et al.
7,370,712 B2 5/2008 Stout et al.
7,506,703 B2 3/2009 Campbell et al.
7,624,818 B2 12/2009 McClain et al.
7,891,441 B2 2/2011 Lee
7,909,100 B2 3/2011 Bryant, Jr. et al.
7,954,570 B2 6/2011 McClain et al.
8,082,988 B2 12/2011 Redlinger et al.
8,540,035 B2 9/2013 Xu et al.
8,555,955 B2 10/2013 Davis
9,022,117 B2 5/2015 Segura et al.
9,938,781 B2 4/2018 Bansal et al.
2002/0144815 A1 10/2002 Van Drentham-Susman et al.
2003/0079913 A1 5/2003 Eppink et al.
2004/0134687 A1* 7/2004 Radford ..... E21B 44/005 175/57
2004/0206547 A1* 10/2004 de Luca ..... E21B 10/32 175/57
2004/0245020 A1 12/2004 Giroux et al.
2005/0039905 A1 2/2005 Hart et al.
2005/0274546 A1* 12/2005 Fanuel ..... E21B 10/32 175/57
2007/0163809 A1 7/2007 Mackay et al.
2008/0115972 A1 5/2008 Lynde et al.
2008/0115973 A1 5/2008 Rives
2008/0169107 A1* 7/2008 Redlinger ..... E21B 17/1014 166/382
2009/0145666 A1 6/2009 Radford et al.
2009/0266544 A1 10/2009 Redlinger et al.
2010/0006290 A1 1/2010 Saylor, III et al.
2010/0065264 A1 3/2010 Nackerud
2010/0126715 A1 5/2010 Dithmar et al.
2010/0276201 A1 11/2010 Makkar et al.
2011/0127044 A1 6/2011 Radford et al.
2011/0220357 A1 9/2011 Segura et al.
2011/0278064 A1 11/2011 Rasheed
2012/0152543 A1 6/2012 Davis
2012/0186823 A1 7/2012 Xu
2012/0325480 A1 12/2012 Schmidt et al.
2015/0101812 A1 4/2015 Bansal et al.
2015/0275606 A1 10/2015 Segura et al.
2016/0130899 A1 5/2016 Cronley

FOREIGN PATENT DOCUMENTS

GB 872547 A 7/1961
GB 2262711 A 6/1993
GB 2352747 A 2/2001
GB 2420359 A 5/2006
GB 2461639 A 1/2010
GB 2486898 A 7/2012
WO 9319281 A1 9/1993
WO 9711250 A1 3/1997
WO 02079604 A2 10/2002
WO 07/11250 A1 1/2007
WO 2014150524 A2 9/2014

OTHER PUBLICATIONS

Weatherford International Ltd.—"A-1 Section Mill" brochure, 2005, 6 pages.
Australian Patent Examination Report dated Feb. 20, 2014, for Australian Application No. 2011227418.
Supplementary Partial European Search Report dated Jan. 27, 2015, for EPO Patent Application No. 11756824.6.
EPO Extended/Supplementary European Search Report dated May 12, 2015, for European Patent Application No. 11756824.6.
Australian Patent Examination Report dated Mar. 2, 2016, for Australian Patent Application No. 2014268147.
Partial European Search Report for Application No. 16196900.1 dated Feb. 3, 2017.
OTS International, Inc. Brochure, "TPXR™ Eccentric Reamers," Copyright 2014, Accessed by Web http://www.otsintl.com/tpxr.asp, Oct. 3, 2017.

(56) References Cited

OTHER PUBLICATIONS

PCT International Search Report and Written Opinion dated May 18, 2011, for International Application No. PCT/US/2011/028430.
PCT International Preliminary Report on Patentability dated Sep. 27, 2012, for International Application No. PCT/US2011/028430.
Canadian Office Action dated Aug. 26, 2013, for Canadian Patent Application No. 2,793,231.
Australian Patent Examination Report dated Feb. 20, 2014, for Australian Patent Application No. 2011227418.
EPO Supplementary Partial European Search Report dated Jan. 27, 2015, for European Application No. 11756824.6.
Australian Patent Examination Report dated Aug. 12, 2016, for Australian Patent Application No. 2014268147.
EPO Extended European Search Report dated Jul. 19, 2017, for European Application No. 16196900.1.
Australian Examination Report dated Sep. 28, 2017, for Australian Patent Application No. 2016262756.
Extended European Search Report in related application EP18196757.1 dated Jan. 7, 2019. (7 pages).
Australian Examination Report dated Nov. 7, 2019, for Australian Patent Application No. 2018256473.

* cited by examiner

201i

SECTION MILL AND METHOD FOR ABANDONING A WELLBORE

CROSS-REFERENCE TO RELATED APPLICATIONS

This Application is a Continuation of application Ser. No. 14/677,002, filed on Apr. 2, 2015; application Ser. No. 14/677,002 is a Divisional of application Ser. No. 13/047,658 filed on Mar. 14, 2011; and application Ser. No. 13/047,658 claims the benefit of U.S. Provisional Application 61/383,627 filed on Sep. 16, 2010 and U.S. Provisional Application 61/313,956 filed on Mar. 15, 2010.

BACKGROUND OF THE INVENTION

Field of the Invention

Embodiments of the present invention generally relate to a section mill and method for abandoning a wellbore.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with the drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be fixed, or "hung" off of the existing casing by the use of slips which utilize slip members and cones to frictionally affix the new string of liner in the wellbore. The second casing or liner string is then cemented. This process is typically repeated with additional casing or liner strings until the well has been drilled to total depth. In this manner, wells are typically formed with two or more strings of casing/liner of an ever-decreasing diameter.

Once the hydrocarbon formations have been depleted, the wellbore must be plugged and abandoned (P&A) using cement plugs. This P&A procedure seals the wellbore from the environment, thereby preventing wellbore fluid, such as hydrocarbons and/or salt water, from polluting the surface environment. This procedure also seals sensitive formations, such as aquifers, traversed by the wellbore from contamination by the hydrocarbon formations. Setting of a cement plug when there are two adjacent casing strings lining the wellbore is presently done by perforating the casing strings and squeezing cement into the formation. This procedure sometimes does not give a satisfactory seal because wellbore fluid can leak to the surface through voids and cracks formed in the cement.

SUMMARY OF THE INVENTION

In one embodiment, a method for milling a tubular cemented in a wellbore includes deploying a bottomhole assembly (BHA) into the wellbore through the tubular, the BHA comprising a window mill; and extending arms of the window mill and radially cutting through the tubular, thereby forming a window through the tubular, wherein a body portion of each window mill arm engages and stabilizes from an inner surface of the tubular after a blade portion of each window mill arm cuts through the tubular.

In another embodiment, method for milling an inner casing and an outer casing in one trip includes deploying a bottomhole assembly (BHA) into the wellbore through the inner casing, the BHA comprising inner and outer window mills and inner and outer section mills; extending arms of the inner window mill and radially cutting through the inner casing, thereby forming a window through the inner casing; longitudinally advancing the BHA while longitudinally milling the inner casing using the extended inner window mill, thereby opening the inner window; and extending arms of the inner section mill through the window and longitudinally milling a section of the inner casing; extending arms of the outer window mill through the milled section of the inner casing and radially cutting through the outer casing; longitudinally advancing the BHA while longitudinally milling the outer casing using the extended outer window mill, thereby opening the outer window; and extending arms of the outer section mill through the outer window and longitudinally milling a section of the outer casing.

In another embodiment, a mill for use in a wellbore includes a tubular housing having a bore therethrough and a plurality of pockets formed in a wall thereof; an arm disposed in each pocket, each arm: having a body portion and a blade portion extending from an outer surface of the body portion, and movable between an extended position and a retracted position; cutters disposed along each blade portion to form a radial cutting face and a longitudinal cutting face; and a pad formed or disposed on an exposed portion of the outer surface of each body portion.

In another embodiment, bottomhole assembly (BHA) for use in a wellbore includes a window mill and a section mill, each mill includes: a tubular housing having a bore therethrough and a plurality of pockets formed in a wall thereof; an arm disposed in each pocket, each arm: having a body portion and a blade portion, and movable between an extended position and a retracted position; cutters disposed along each blade portion; and a piston operable to move the arms from the retracted position to the extended position, wherein: each window mill blade portion has a length, an outer surface of each window mill blade portion tapers inwardly, each section mill blade portion has a length substantially greater than the length of the window mill blade portion, and an outer surface of each section mill blade portion is straight.

In another embodiment, a mill for use in a wellbore includes a tubular housing having a bore therethrough and a plurality of eccentrically arranged pockets formed in a wall thereof; an arm disposed in each pocket, each arm having a body portion and a blade portion, movable between an extended position and a retracted position, and having a plurality of inclined grooves formed along a side thereof; a set of one or more guides connected to the housing for each groove, each guide set having an inclination corresponding to the inclination of the grooves; cutters disposed along each blade portion; a flow tube disposed in the housing, having a bore therethrough in fluid communication with the housing bore, and having one or more first ports and one or more second ports formed though a wall thereof; a blade piston connected to the flow tube, having one or more passages formed therethrough in communication with the pockets, wherein the passages are in communication with the first ports when the arms are in the extended position; a booster piston connected to the flow tube, in fluid communication with the second ports, and operable to move the arms from the retracted position to the extended position.

In another embodiment, a method for milling a tubular cemented in a wellbore includes deploying a bottomhole assembly (BHA) into the wellbore through the tubular, the BHA comprising a window mill and a section mill; extending arms of the window mill and radially cutting through the tubular while arms of the section mill are locked in a retracted position, thereby forming a window through the tubular, wherein a body portion of each window mill arm engages and stabilizes from an inner surface of the tubular after a blade portion of each window mill arm cuts through the tubular; longitudinally advancing the BHA while longitudinally milling the tubular using the extended window mill, thereby opening the window to a length less than a length of a joint of the tubular; and extending arms of the section mill through the window and longitudinally milling a section of the tubular while maintaining the window mill in the extended position for stabilization.

In another embodiment, a method for milling a casing or liner cemented in a wellbore includes deploying a BHA into the wellbore through the casing or liner, the BHA including a radial cutout and window (RCW) mill and a section mill; extending arms of the RCW mill and radially cutting through the casing or liner at a location between couplings of the casing or liner while arms of the section mill are locked in a retracted position, thereby starting a window through the casing or liner, wherein a body portion of each arm engages and stabilizes from an inner surface of the casing or liner after a blade portion of each arm cuts through the casing or liner; longitudinally advancing the BHA while longitudinally milling the casing or liner using the extended RCW mill until the RCW mill is exhausted, thereby finishing the window, wherein a length of the window is less than a length of a joint of the casing or liner; and extending arms of the section mill through the window and longitudinally milling a section of the casing or liner while maintaining the exhausted RCW mill in the extended position for stabilization.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
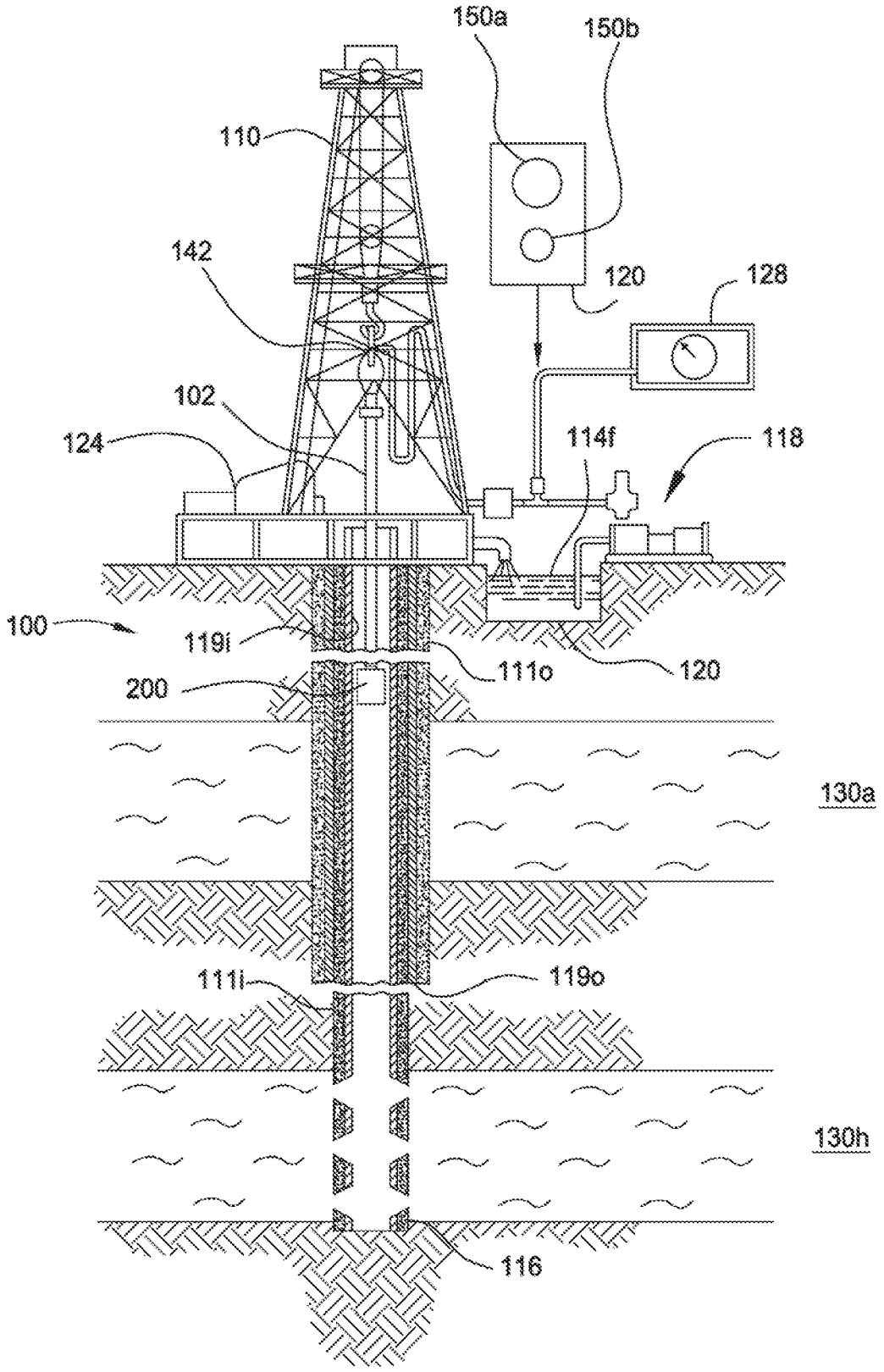
FIG. 1 illustrates a milling system for abandoning a wellbore, according to one embodiment of the present invention.

FIG. 1 illustrates a milling system for abandoning a wellbore 116, according to one embodiment of the present invention. The milling system may include a drilling or workover rig and workstring 100 deployed using the drilling rig. The rig may include a derrick 110 and drawworks 124 for supporting a top drive 142. The top drive 142 may in turn support and rotate the workstring 100. Alternatively, a Kelly and rotary table (not shown) may be used to rotate the workstring 100 instead of the top drive. The workstring 100 may include deployment string 102 and a bottomhole assembly (BHA) 200. The deployment string 102 may include joints of threaded drill pipe connected together or coiled tubing. If the deployment string 102 is coiled tubing, the top drive 142 and derrick 110 may be omitted and the BHA 200 may include a mud motor (not shown).

A rig pump 118 may pump milling fluid 114*f*, such as drilling mud, out of a pit 120, passing the mud through a stand pipe and Kelly hose to the top drive 142. The fluid 114*f* may continue into the deployment string, through a bore of the deployment string 102, through a bore of the BHA 200, and exit the BHA. The fluid 114*f* may lubricate the BHA 200 and carry cuttings to surface. The milling fluid and cuttings, collectively returns, may flow upward along an annulus formed between the workstring 100 and an inner casing 119*i*, through a solids treatment system (not shown) where the cuttings are separated. The treated milling fluid may then be discharged to the mud pit for recirculation.

The drilling rig may further include a launcher 120 for deploying one or more closure members, such as balls 150*a,b*, and a pressure sensor 128 in communication with an outlet of the rig pump 118. The wellbore may be land based (shown) or subsea (not shown). If subsea, the wellhead may be at the seafloor and the rig may be part of a mobile offshore drilling unit or intervention vessel or the wellhead may be at the waterline and the rig may be located on a production platform.

A first section of the wellbore 116 has been drilled. An outer casing string 1190 has been installed in the wellbore 116 and cemented 1110 in place. The outer casing string 1190 may isolate a fluid bearing formation, such as aquifer 130*a*, from further drilling and later production. Alternatively, fluid bearing formation 130*a* may instead be hydrocarbon bearing and may have been previously produced to depletion or ignored due to lack of adequate capacity. A second section of the wellbore 116 has been drilled. The inner casing string 119*i* has been installed in the wellbore 116 and cemented 111*i* in place. The inner casing string has been perforated and hydrocarbon bearing formation 130*b* has been produced, such as by installation of production tubing (not shown) and a production packer. Once hydrocarbon bearing formation 130*b* is depleted, it may be desirable to plug and abandon (P&A) the wellbore 116. To begin the P&A operation, the production tubing and packer may be removed from the wellbore. Alternatively, the production packer may be drilled or milled out.

Figure 2A:
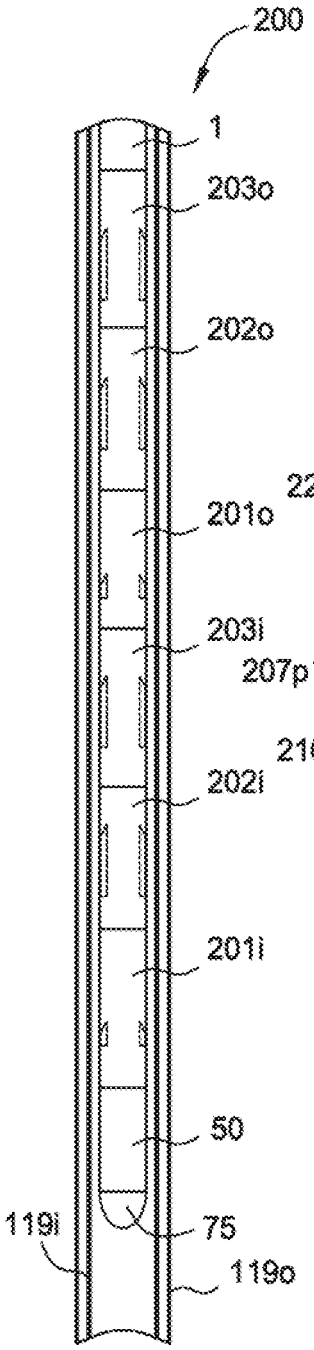
FIG. 2A illustrates a bottomhole assembly (BHA) of the milling system.

FIG. 2A illustrates the BHA 200 of the milling system. The BHA 200 may include one or more radial cutout and window (RCW) mills 201*i,o* and one or more section mills 202*i,o*, 203*i,o*. As shown, the BHA 200 includes a first stage inner RCW mill 201*i* for milling the inner casing string 119*i*, such as seven inch diameter casing, and second 202*i* and third stage 203*i* inner section mills for milling the inner casing string and a first stage outer RCW mill 2010 for milling the outer casing string 119*o*, such as nine and five-eighths inch diameter casing, and second 202*o* and third 203*o* stage outer section mills for milling the outer casing string. The BHA 200 may further include a disconnect 1, catcher 50, and a shoe, such as guide shoe or drill bit 75. Each component of the BHA 200 may be connected to one another, such as by threaded couplings.

Figure 2B:
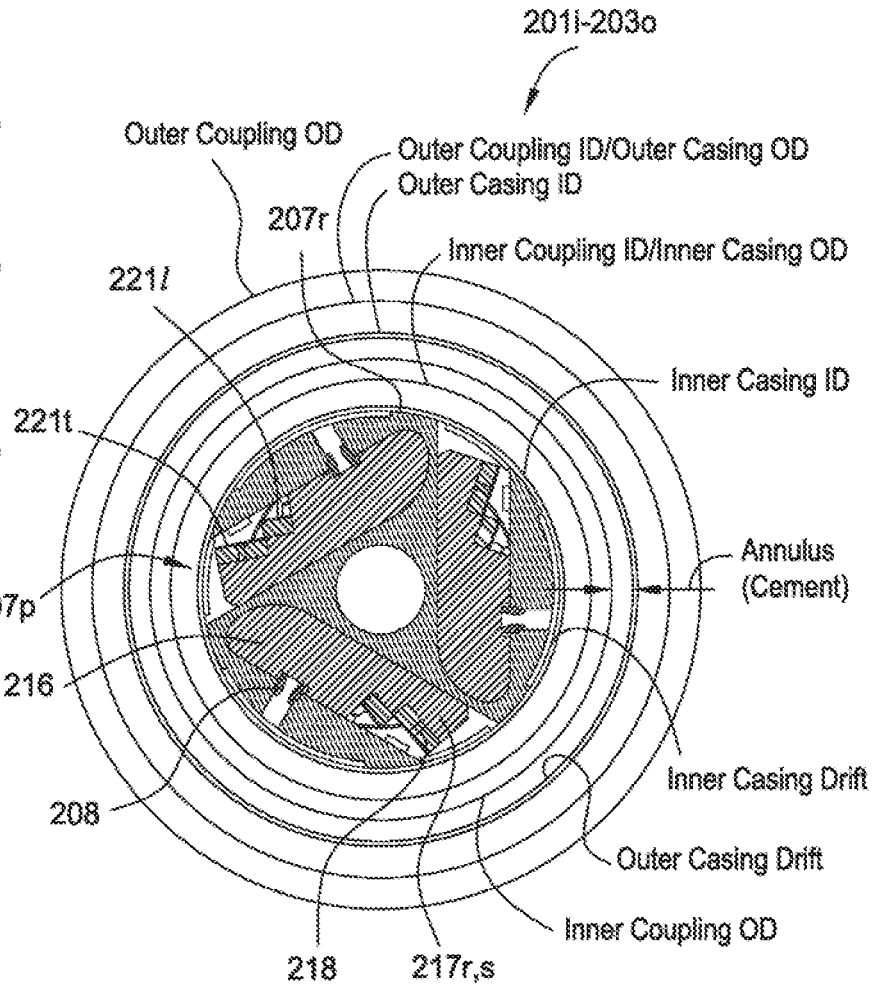
FIG. 2B is a radial cross section generic to any of mills of the BHA in a retracted position.
Figures 3A, 3B, 3C:
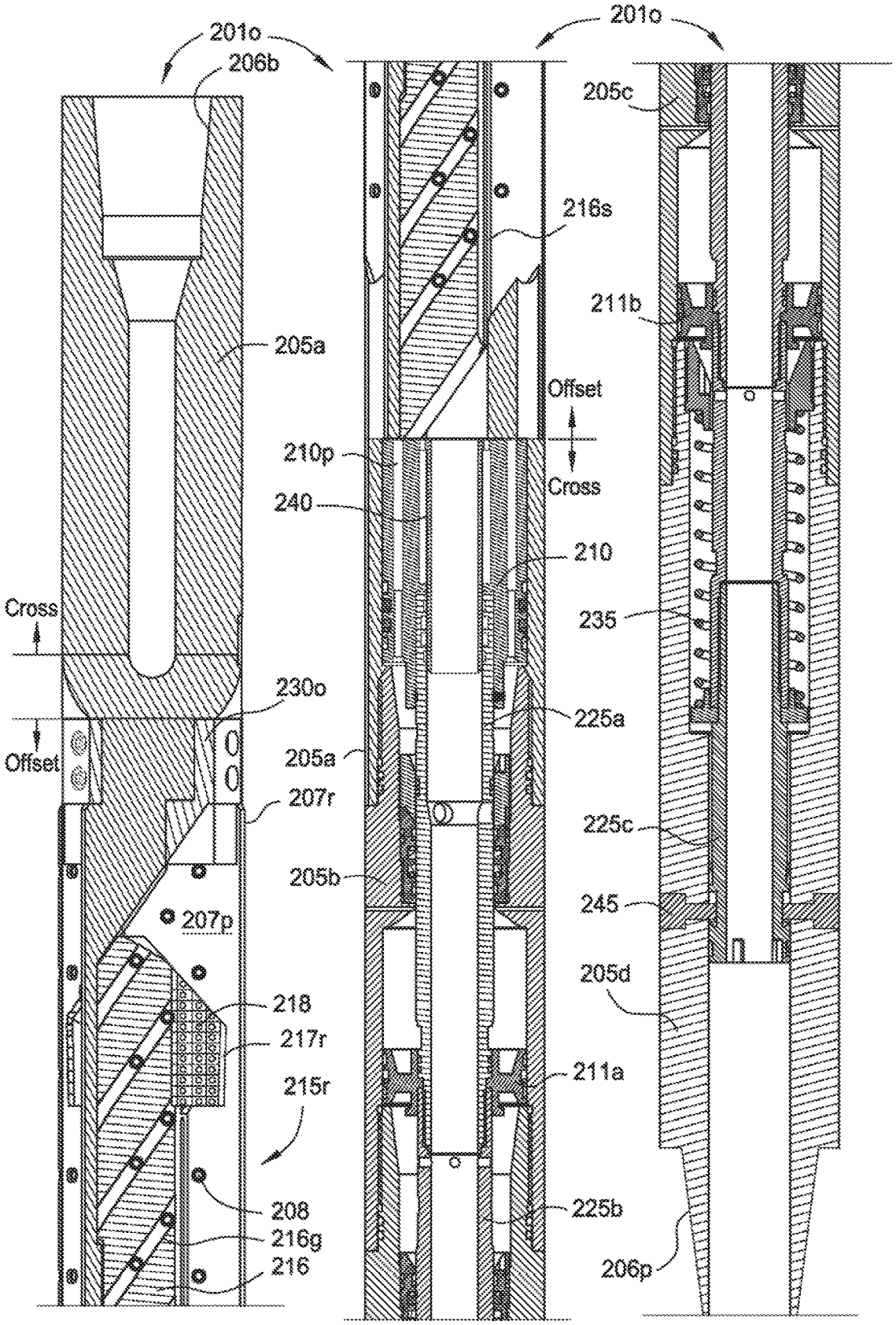
FIGS. 3A-3C are a longitudinal section of the outer radial cutout and window (RCW) mill in a retracted position.
Figures 4A, 4B, 4C:
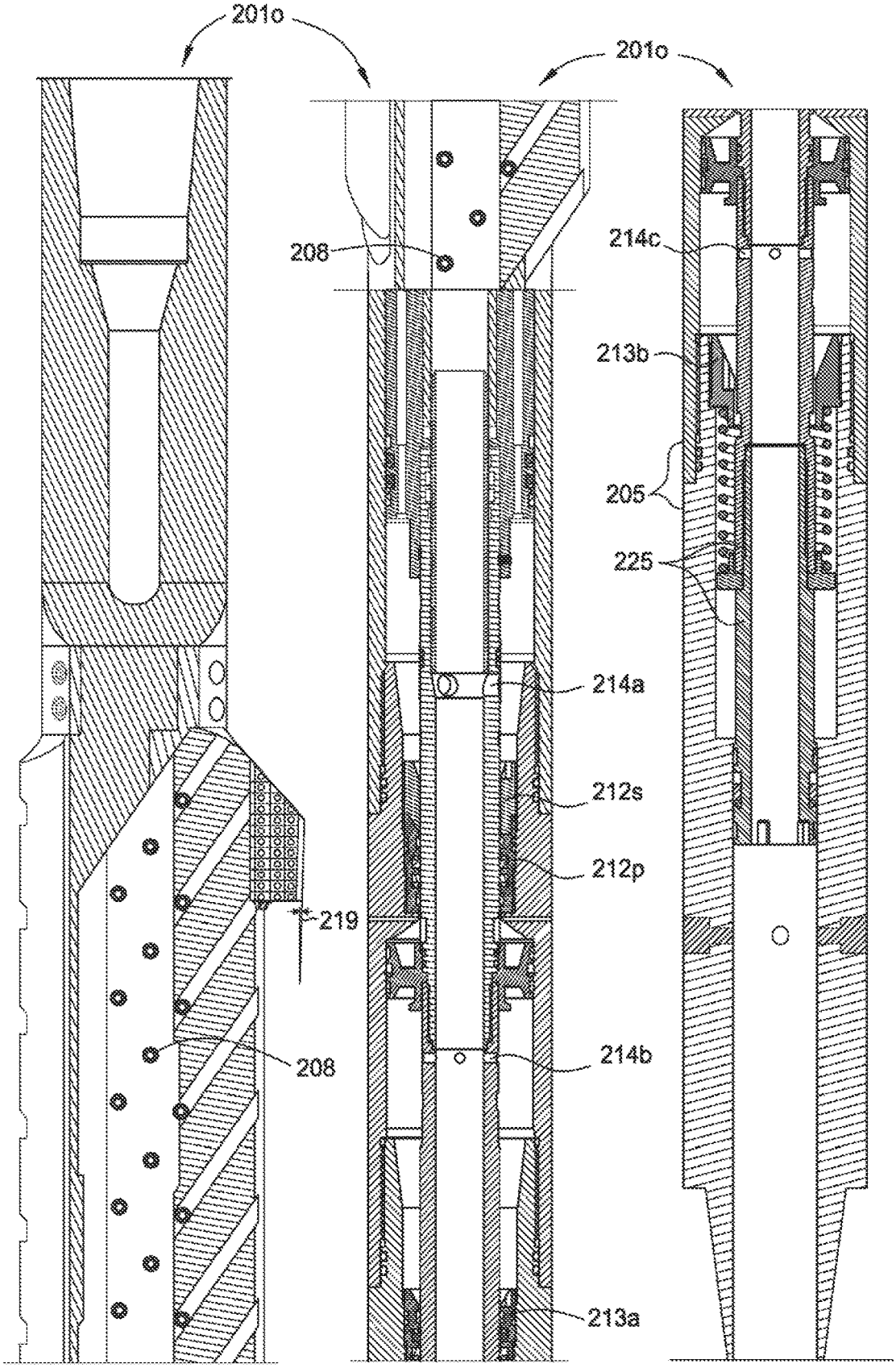
FIGS. 4A-4C are a longitudinal section of the outer RCW mill in an extended position.

FIG. 2B is a radial cross section generic to any of the mills 201*i,o*-203*i,o* in a retracted position. FIGS. 3A-3C are a longitudinal section of the outer RCW mill 2010 in a retracted position. FIGS. 4A-4C are a longitudinal section of the outer RCW mill 2010 in an extended position.

The outer RCW mill 2010 may include a housing 205, one or more pistons 210, 211*a,b*, a plurality of arms 215*r*, a biasing member, such as a spring 235, and a flow tube 225. The housing 205 may be tubular, have a bore formed therethrough, and include one or more sections 205*a-d* connected by couplings, such as threaded couplings. The upper 205*a* and lower 205*d* sections may each have threaded couplings, such as a box 206*b* and a pin 206*p*, formed at longitudinal ends thereof for connection to another mill, another BHA component, or the deployment string 102.

Each arm 215*r* may be movable relative to the housing 205 between a retracted position and an extended position. The housing 205 may have a pocket 207*p* formed therein for each arm 215*r*. The housing 205 may also have a pair of ribs 207*r* formed in an outer surface thereof on each side of each pocket 207*p* and extending along the housing outer surface for at least a length of the pocket. One or more of the ribs 207*r* may slightly overlap the respective pocket 207*p*. A nominal outer diameter of the housing 205 may be slightly less than the drift diameter of the inner casing 119*i*. The ribbed outer diameter of the housing 205 may be essentially equal to the drift diameter of the inner casing 119*i*, such as a line fit having an allowance of less than or equal to one, three-fourths, one-half, or one-fourth percent of the drift diameter (and greater than or equal to zero). The ribs 207*r* may act as a stabilizer during milling, reinforcement for the housing 205, and/or extend the sweep of the mill 2010.

Each arm 215*r* may be disposed in the pocket 207*p* in the retracted position and at least a portion of each arm may extend outward from the pocket in the extended position. Each pocket 207*p* may be eccentrically arranged relative to the housing 205 and each arm 215*r* may have an eccentric extension path relative to the housing resulting in a far-reaching available blade sweep (discussed below). Each arm 215*r* may have an inner body portion 216 and an outer blade portion 217*r*. The body portion 216 may have an actuation profile formed in one side thereof and a housing surface defining the pocket and facing the actuation profile may have a mating guide extending therefrom. The actuation profile may be a series of inclined grooves 216*g* spaced along the body portion 216. For each groove 216*g*, the guide may be a set of fasteners 208, such as pins, received by respective openings formed through a wall of the housing 205 between an outer surface of the housing and a respective pocket 207*p*. The fasteners 208 may be pressed, threaded, or bonded into each opening, such as by brazing, welding, soldering, or using an adhesive. Each set of fasteners 208 may be arranged along an inclined path corresponding to a respective groove 216*g*.

The actuation profile and guide may be operable to move the arm 215*r* radially outward as the arm is pushed longitudinally upward by the pistons 210, 211*a,b*. The actuation profile and guide may also serve to mechanically lock the arms 215*r* in the extended position during longitudinal milling as longitudinal reaction force from the outer casing 1190 pushes the blade portion 217*r* against an arm stop 230*o* fastened to the housing 205, thereby reducing or eliminating any chattering of the blade portions due to pressure fluctuations in the milling fluid 114*f*. The actuation profile and guide may move each arm without pivoting.

Cutters 218 may be bonded into respective recesses formed along each blade portion 217*r*. The cutters 218 may be made from a hard material, such as a ceramic or cermet, such as tungsten carbide. The cutters 218 may be pressed or threaded into the recesses. Alternatively, the cutters 218 may be bonded into the recesses. Alternatively, the cutters 218 may be made from a super-hard material, such as polycrystalline diamond compact (PDC), natural diamond, or cubic boron nitride and the mill may be used as an underreamer instead. The cutters 218 may be disposed in the recesses to form a radial cutting face and a longitudinal cutting face.

Each blade portion 217*r* may have a short length relative to blade portions of the outer section mills 201*o*, 202*o* and relative to a length of a respective body portion 216. An outer surface of each blade portion 217*r* may also taper 219 slightly inwardly from a top of the mill 2010 to a bottom of the mill. The short blade portion 217*r* may advantageously provide increased cutting pressure when starting a window 160*o* (FIG. 10B) through the outer casing 119*o*, thereby reducing or eliminating any bearing effect. The taper 219 in the blade portion 217*r* may ensure that an upper portion of the blade portion engages the outer casing inner surface before the rest of the blade portion, thereby further increasing cutting pressure. The short blade portion 217*r* may also provide a relatively short cutting lifespan to form a relatively short window. The cutting lifespan may less than or equal to the length of a joint of the casing (typically forty feet), such as one-third, one-half, two thirds, or three-quarters the joint length and be greater than or equal to the length of the outer section mill blade portions. When extended, a sweep of the outer RCW mill 2010 may be equal to or slightly greater than the outer casing coupling outer diameter and the outer RCW mill may be capable of cutting the window through both the outer casing 1190 and the outer coupling.

Figures 11A, 11B:
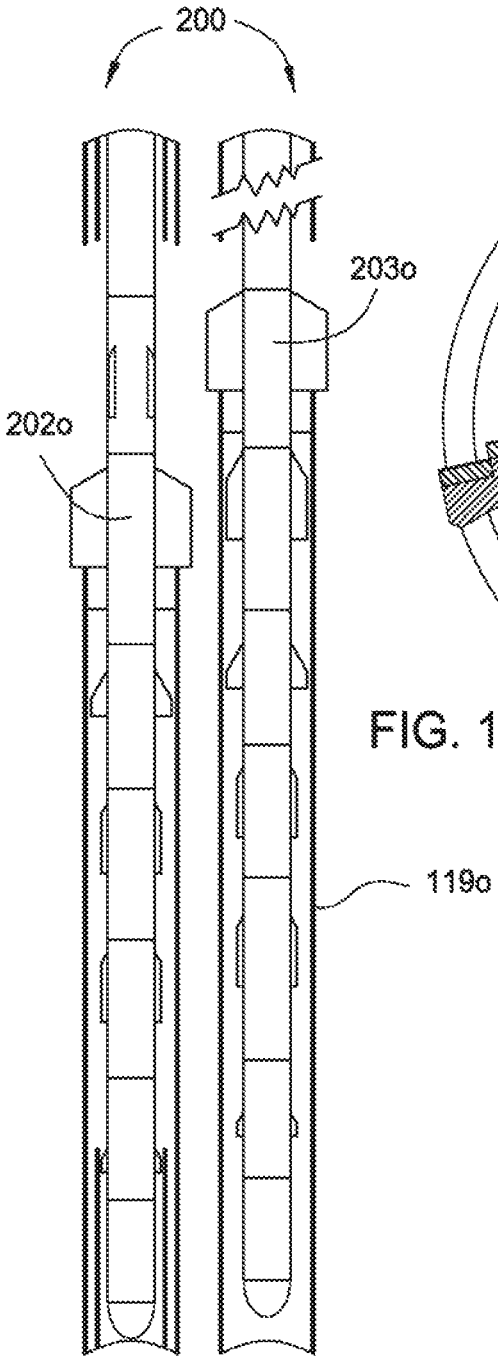
FIGS. 11A-11D illustrate operation of the outer second stage and third stage section mills.
Figure 11C:
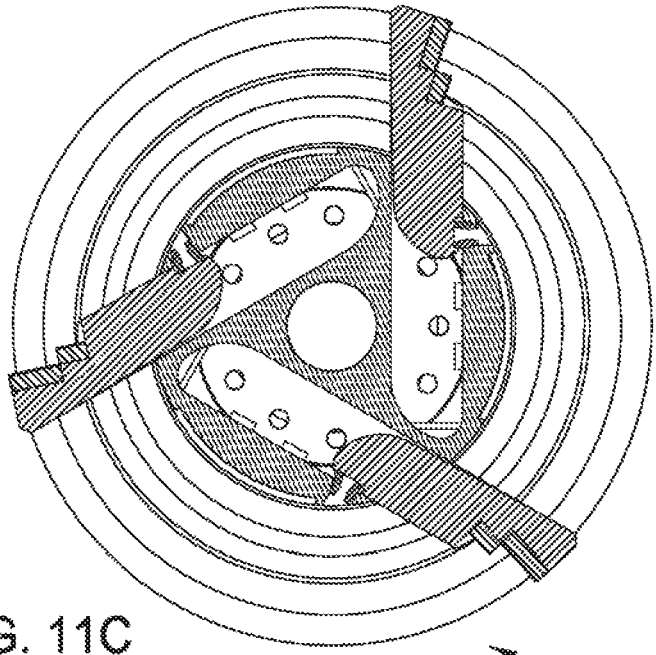
Figure 11D:
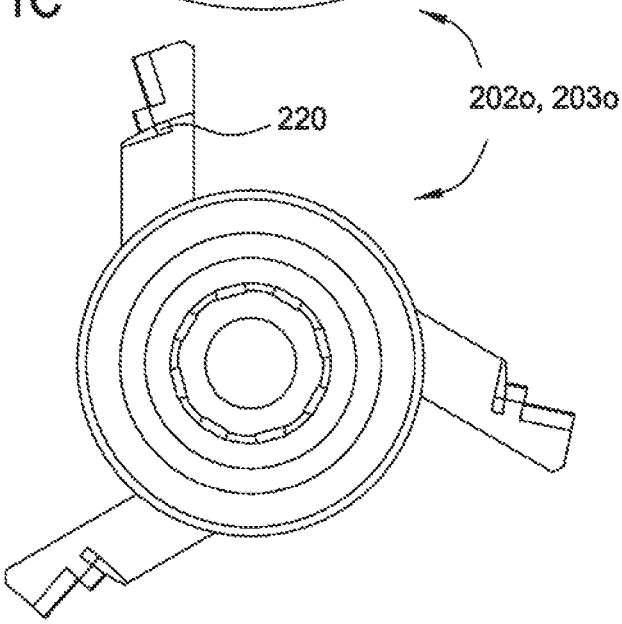

Each body portion 216 may have a groove 216*s* formed along an exposed portion (not having the blade portion) of an outer surface thereof. A pad 220 (see FIG. 11D) may be bonded or pressed into the groove 216*s*. The pad 220 may be made from the hard or super hard material. The pads 220 may serve to stabilize the outer RCW mill 2010 by engaging an inner surface of the outer casing after the outer RCW blade portion 216 has cut through the casing. Once the blade portions 217*r* have worn off, the body portion 16 may continue to serve as a stabilizer for the outer section mills 202, 203*o*. A slight inner portion of the blade portion 217*r* may or may not remain to serve as a scraper. Alternatively, the groove and/or the pad may extend along only a portion of the body portion outer surface. Alternatively, the pad may be the exposed outer surface of the body portion instead of an insert and the exposed outer surface may be surface hardened or coated.

Each blade portion 217*r* may have two sets of cutters 218, the sets staggered to form a lead cutting surface 221*t* for the casing and a trail cutting surface 221*t* for the coupling. The blade sweep of the outer RCW mill 2010 may be substantially greater than a nominal outer diameter of the housing, such as greater than fifty percent, sixty-seven percent, seventy-five percent, or eighty-five percent greater. For example, for the seven inch diameter inner casing, the housing may have a nominal outer diameter equal to five and three-quarter inches and the blade sweep may be equal to ten and five-eighths inches or greater. The blade sweep may be adjusted by modification of the arm stop 230*o*.

An upper surface of each arm 215*r* may be inclined for engaging the inner casing string (upper surface of an inner window 160*i* (FIG. 8A)) and partially or fully retracting the arms 215*r* once the milling operation is complete. The retraction inclination may be perpendicular to the inclination of the actuation profile and the guide. A lower surface of the body portion 216 and a slight inner portion of the body portion upper surface may be inclined corresponding to the actuation profile and guide.

The flow tube 225 may disposed in the housing bore and be longitudinally movable relative to the housing 205. The flow tube 225 may include one or more sections 225*a-d* connected by couplings, such as threaded couplings. The blade piston 210 may be connected to the flow tube at an upper end thereof by having a shoulder engaging a top of the flow tube 225 and one or more fasteners, such as set screws. Each booster piston 211*a,b* may be connected to the flow tube 225, such as by a threaded connection. The flow tube 225 may have one or more ports 214*a-c* formed through a wall thereof corresponding to each piston 210, 211*a,b*. An extension 240 may be connected to the housing 205, such as by a threaded connection.

A blade piston chamber may be formed in a wall of the housing 205 and between the housing and the extension 240 and be sealed at a lower end by a blade partition 212*p* connected to the housing 205, such as by a threaded connection. An upper end of the blade piston chamber may be in fluid communication with the pockets 207*p*. An upper end of the flow tube 225 may sealingly engage an outer surface of the extension 240 and a first set of ports 214*a* may provide fluid communication between the flow tube bore and the blade piston chamber.

The blade piston 210 may have one or more passages 210*p* formed longitudinally therethrough for diverting a portion of the milling fluid 114*f* to flush cuttings from the pockets 207*p* and cool the blade portions 217*r*. A seat 212*s* may be connected to the blade partition 212*p* and may sealingly engage an outer surface of the flow tube 225 in the retracted position, thereby closing the ports 214*a* and preventing flow through the passages 210*p* until the outer RCW mill 2010 is being extended. Opening of the ports 214*a* may result in a slight pressure decrease in the housing bore when the ports open due to flow through the pockets 207*p* which may or may not be detectable at the rig. As the arms 215*r* fully extend, the bore pressure may increase due to the arms obstructing flow through the pockets 207*p*, thereby providing a pressure increase detectable at the rig (using the sensor 128).

Each booster piston 211*a,b* may be disposed between the housing 205 and the flow tube 225. A first booster piston chamber may be formed between the blade partition 212*p* and a first booster partition 213*a* connected to the housing 205 and a second booster piston chamber may be formed between the first booster partition and a second booster partition 213*b* connected to the housing 205. A second set of ports 214*b* may provide fluid communication between the flow tube bore and the first booster piston chamber and a third set of ports 214*c* may provide fluid communication between the flow tube bore and the second booster piston chamber. An upper portion of each booster piston chamber may be vented by one or more equalization ports formed through a wall of the housing.

The spring 235 may be disposed between the second booster partition 213*b* and a shoulder of the flow tube 225, thereby longitudinally biasing the pistons 210, 211*a,b* and the flow tube 225 away from the arms 215*r* and toward the retracted position. The spring 235 may be disposed in a spring chamber formed between the second booster partition 213*b* and a shoulder of the housing 205. The spring chamber may be in fluid communication with the ports 214*c* via a gap formed between the second booster partition 213*b* and the flow tube 225. The flow tube 225 may initially be fastened to the housing 205 by one or more frangible fasteners, such as shear screws 245.

Figures 5A, 5B:
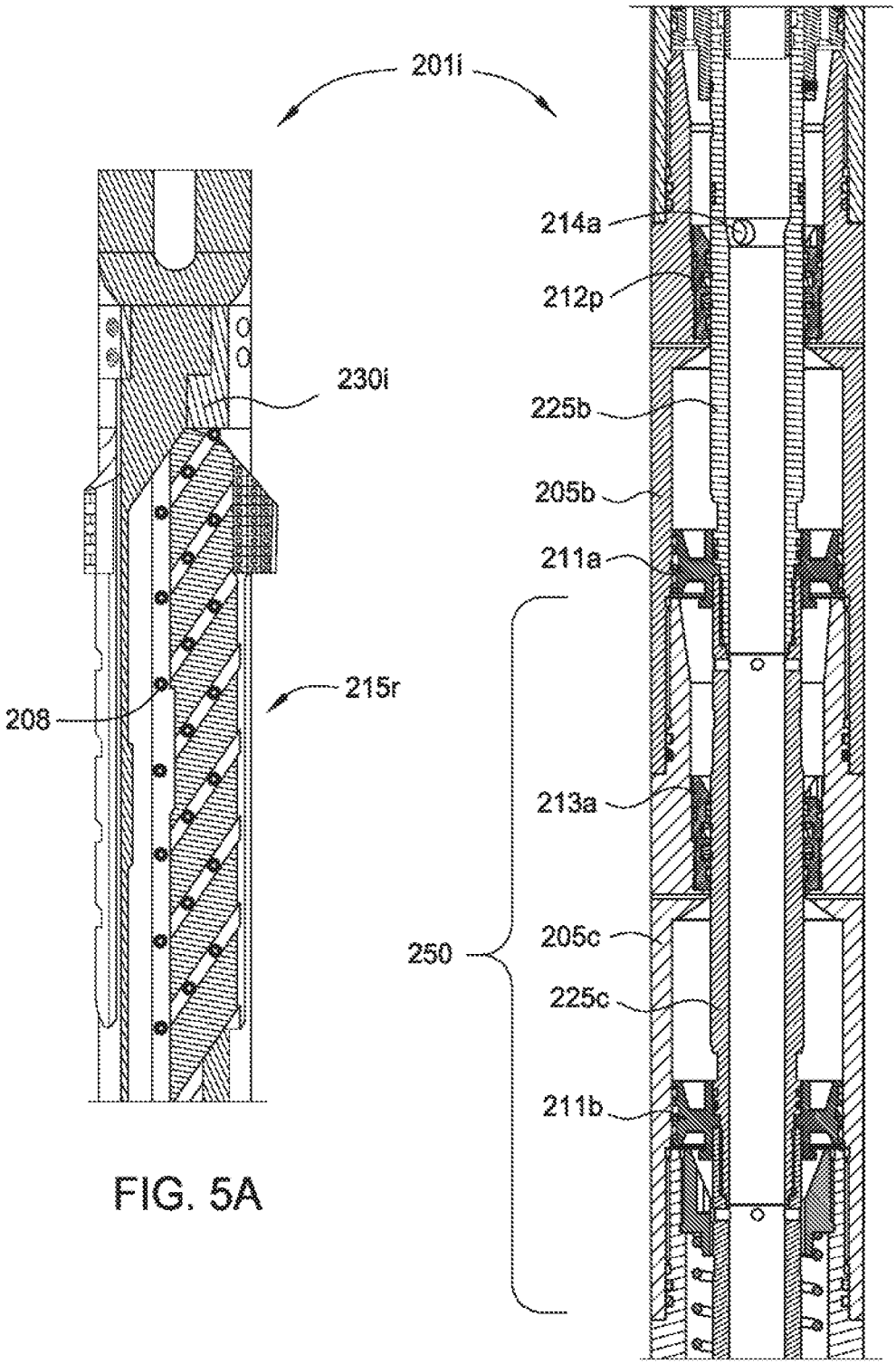
FIG. 5A is an offset section of an arm of the inner RCW mill in an extended position.
FIG. 5B is a cross section of a middle portion of the inner RCW mill in a retracted position.

FIG. 5A is an offset section of an arm 215*r* of the inner RCW mill 201*i* in an extended position. FIG. 5B is a cross section of middle portion of the inner RCW mill 201*i* in a retracted position. The inner RCW mill 201*i* may be similar or identical to the outer RCW mill 2010 except for a few differences. The arm stop 230*o* may be replaced by arm stop 230*i* extended to adjust the sweep of the blade portions 217*r* to correspond to the inner casing 119*i*. When extended, a sweep of the inner RCW mill 201*i* may be equal to or slightly greater than the inner casing coupling outer diameter and the inner RCW mill may be capable of cutting the window 160*i* through both the inner casing 119*i* and the inner coupling. The seat 212*s* may be omitted so that the ports 214*a* are open in the retracted position. Further, the shear screws 245 may be omitted from the inner RCW mill 201*i*. Alternatively, the inner RCW mill may include one or more of the shear screws 245.

Referring specifically to FIG. 5B and applicable to any of the mills 201*i*-203*i*, 2010-203*o*, the second booster piston 211*b*, housing section 205*c*, flow tube section 225*c*, and first booster partition 213*a* may form a booster module 250. Depending on the desired actuation force for the particular application of the particular mill, the booster module 250 may be omitted, a single module may be used, or additional modules (not shown) may be added to any of the mills.

Figure 6A:
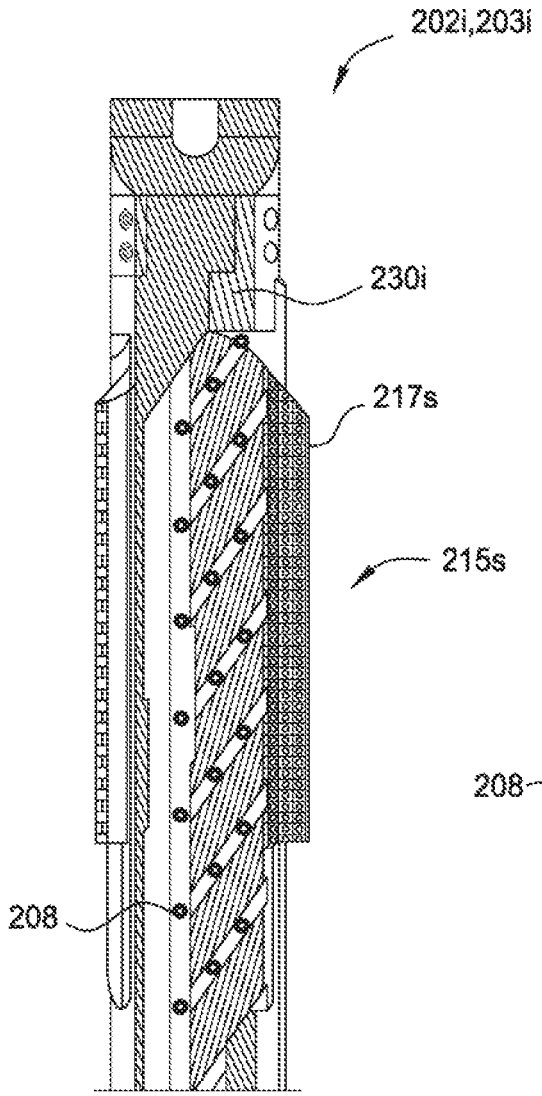
FIG. 6A is an offset section of an arm of one of the inner section mills in an extended position.
Figure 6B:
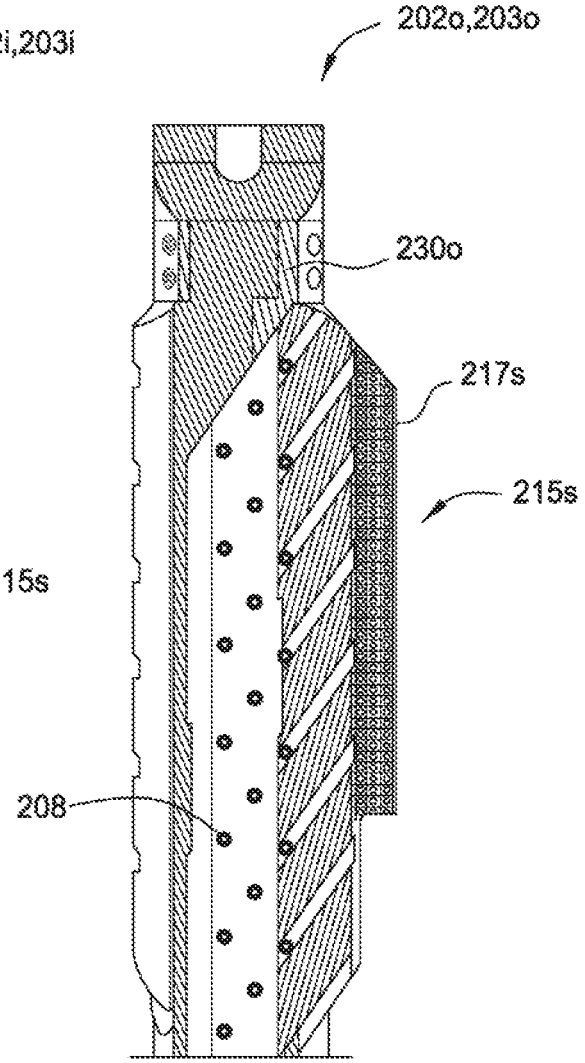
FIG. 6B is an offset section of an arm of one of the outer section mills in an extended position.

FIG. 6A is an offset section of an arm 215*s* of one of the inner section mills 202*i*, 203*i* in an extended position. FIG. 6B is an offset section of an arm 215*s* of one of the outer section mills 202*o*, 203*o* in an extended position. The outer section mills 202*o*, 203*o* may be similar or identical to the outer RCW mill 2010 except that arms 215*r* may be replaced by arms 215*s*. The inner section mills 202*i*, 203*i* may be similar or identical to the outer section mills 202*o* except that arms 215*r* may be replaced by arms 215*s* and the arm stops 230*o* may be replaced by the arm stops 230*i*. Further, as discussed above, the section mills 202*i,o*, 203*i,o* may have less (including zero) booster modules 250 than the outer RCW mill 201*o*. As such, one of the mills may be converted to any other mill by simply replacing the arms 215*r,s*, stops 230*i,o*, adding or removing booster modules 250, and adding or removing the seat 212*s* (not all required depending on which mill is being converted to which other mill).

The section mill blade portions 217*s* may be substantially longer than the RCW mill blade portions 217*r*, such as two to six times the length of the RCW blade portions and may have a length corresponding to a length of the body portion 216. A length of the section mill blade portions 217*s* may ensure a long cutting lifespan, such as greater than or equal to one hundred feet of casing (including couplings). As with the RCW blade portions 217*r*, once the section mill blade portions wear off, the body portions 216 (with or without a slight remaining portion of the blade portion) may serve as a stabilizer for the next section mill of the particular size.

An outer surface of the section mill blade portions 217*s* may be straight. A sweep of the section mill blade portions 217*s* may correspond to the respective casing coupling outer diameter so that the blade portion may mill both the outer casing 1190 and the outer casing coupling. A sweep of the inner section mill blade portions 217*s* may extend to the drift diameter of the outer casing 1190 so that cement and centralizers located between the casing strings 119*i,o* may also be milled.

Alternatively, as illustrated in FIGS. 14D and 15D of the '627 provisional, a second pad (not shown) may be disposed in an outer surface of each of the section mill blade portions for engaging an inner surface of the outer casing for the inner section mills and for engaging an inner surface of cement or wellbore wall for the outer pads. The second pads may serve as stabilizers during section milling. The second pad may be made from the hard or super hard material.

Figure 7A:
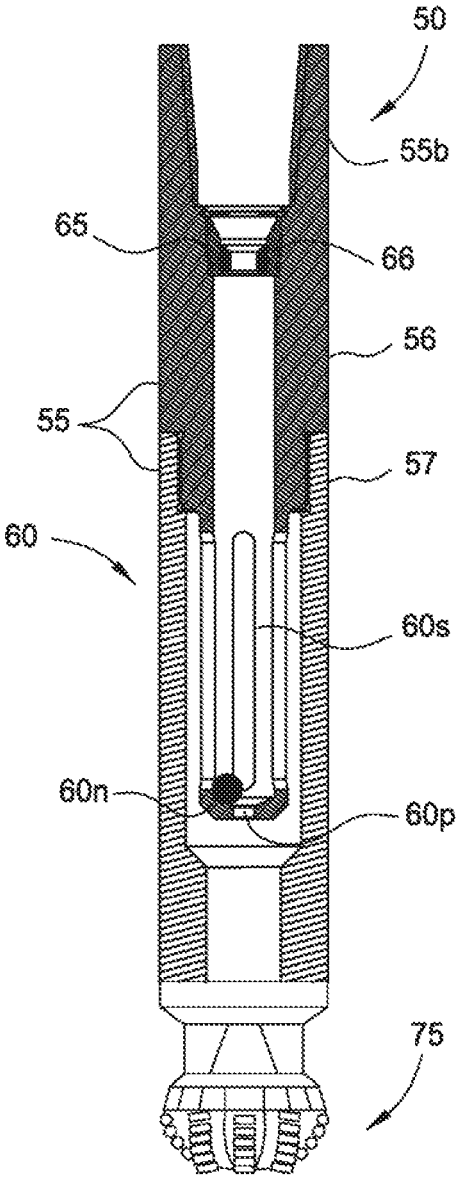
FIG. 7A illustrates a catcher and drill bit of the BHA.

FIG. 7A illustrates a catcher 50 and drill bit 75 of the BHA 200. The catcher 50 may receive a plurality of balls 150*a,b* so that the mills may be selectively operated (discussed below) during one trip of the workstring. The catcher 50 may include a tubular housing 55 and a ball seat 65. The housing 55 may have couplings 55*b* formed at each longitudinal end thereof for connection with other components of a workstring. The couplings may be threaded, such as a box 55*b* and a pin (not shown). The housing 55 may include one or more sections 56, 57 connected by couplings, such as threaded couplings. The housing 55 may have a flow path formed therethrough for conducting milling fluid.

A lower portion of the upper housing section 56 may form a cage 60. The cage 60 may be made from an erosion resistant material, such as a tool steel or cermet, or be made from a metal or alloy and treated, such as a case hardened, to resist erosion. The cage 60 may be perforated, such as slotted 60*s*. The slots 60*s* may be formed through a wall of the cage 60 and spaced therearound. A length of the slots 60*s* may correspond to a ball capacity of the catcher 50. A lower end of the cage 60 may form a nose 60*n*. A port 60*p* may be formed through the nose 60*n* and have a diameter substantially less than a diameter of the smallest ball 150*a,b*. An annulus may be formed between the cage 60 and the lower housing section 57. The annulus may serve as a fluid bypass for the flow of milling fluid 141*f* through the catcher 50. The first caught ball may land on the nose 60*n*. Milling fluid 141*f* may enter the annulus from the housing bore through the slots 60*s*, flow around the caught balls along the annulus, and reenter the housing bore below the nose 60*n*.

Each of the balls 150*a,b* may include a core and cladding. The cladding may be made from a resilient material, such as a polymer, and the cladding may be made from a high density material to control buoyancy (i.e., negative). The seat 65 may be fastened to the upper housing section 56, such as by a threaded connection. The seat 65 may have a conical inner surface to accommodate a plurality of differently sized balls and to facilitate squeezing therethrough. A liner 66 may be made from the erosion resistant material and may be fastened to the seat. The liner 66 may facilitate using of the seat 65 as a choke to increase pressure in the BHA 200 (above the catcher 50) and relative to the annulus pressure (discussed below). Each of the balls 150*a,b* may have a diameter greater than a minimum diameter of the seat 65 such that the ball will land and seal against the seat when dropped or pumped through the deployment string 102 and the portion of the BHA 200 (above the catcher 50). Pressure may then be increased to operate one of the section mills 202*i,o*, 203*i,o* or the outer RCW mill 201*o*. Pressure may then be further increased to a predetermined threshold (dependent on the diameter of the particular ball) to squeeze the ball through the seat 65. A diameter of the ball core may be less than the minimum diameter of the seat 65 so that the core does not obstruct squeezing of the ball through the seat.

Figure 7B:
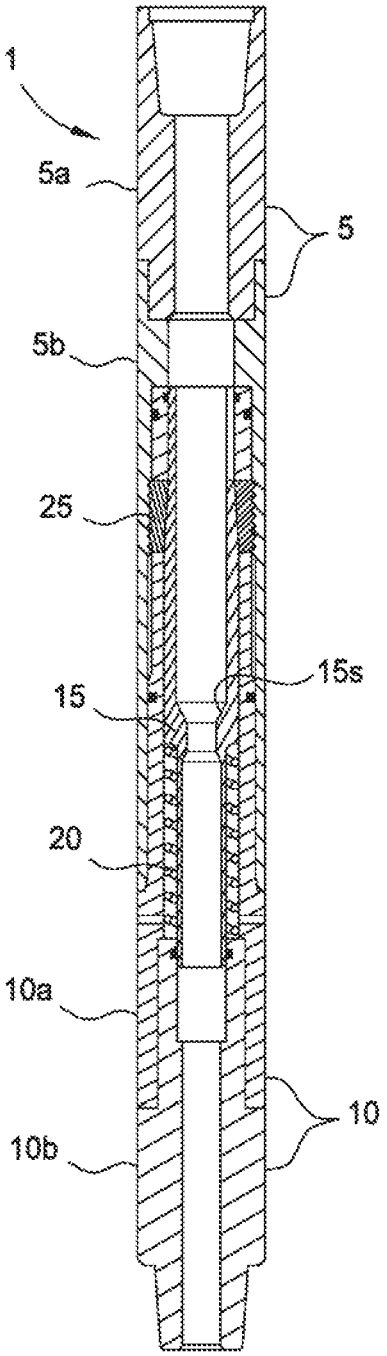
FIG. 7B is a cross section of a disconnect of the BHA.

FIG. 7B is a cross section of a disconnect 1 of the BHA 200. In the event that the BHA 200 becomes stuck in the wellbore, the disconnect 1 may be operated to release the BHA 200 from the deployment string 102 so that the deployment string may be retrieved from the wellbore 116. The disconnect 1 may include a housing 5, a mandrel 10, an actuator 15, 20, and threaded dogs 25. The mandrel 10 and the housing 5 may each be tubular and the each may have a threaded coupling formed at a longitudinal end thereof for connection with other components of the workstring. Each of the housing 5 and mandrel 10 may include a plurality of sections 5*a,b*, 10*a,b*, each section connected, such as by threaded connections, and sealed, such as by O-rings.

In a locked position, the dogs 25 may be disposed through respective openings formed through the mandrel 10 and an outer surface of each dog may form a portion of a thread corresponding to a threaded inner surface of the housing 5. Abutment of each dog 25 against the mandrel wall surrounding the opening and engagement of the dog thread portion with the housing thread may longitudinally and rotationally connect the housing 5 and the mandrel 10. Each of the dogs 25 may be an arcuate segment, may include a lip (not shown) formed at each longitudinal end thereof and extending from the inner surface thereof, and have an inclined inner surface. A dog spring (not shown) may disposed between each lip of each dog 25 and the mandrel, thereby radially biasing the dog inward away from the housing 5.

The actuator may include a sleeve 15 and a biasing member 20, such as a spring. The sleeve 15 may be longitudinally movable between the locked position (shown) and an unlocked position (not shown). The actuator spring 20 may be disposed in a chamber formed between the sleeve 15 and the mandrel 10 and act against a shoulder of the sleeve and the mandrel, thereby biasing the sleeve into engagement with the dogs 25. An upper portion of the actuator sleeve 15 may have a conical outer surface and an inner surface of each dog 25 may have a corresponding inclination. Engagement of the sleeve 15 with the dogs 25 may push the dogs radially into engagement with the housing thread. An inner surface of the actuator sleeve 15 may form a seat 15*s* for receiving a closure member, such as a ball (not shown). The seat may have a minimum diameter greater or substantially greater than a maximum diameter of the balls 150*a,b* so that the disconnect seat 15*s* does not interfere with the balls 150*a,b*.

In operation, if it becomes necessary to operate the disconnect 1, the BHA 200 may be set on a bottom of the wellbore 116 and the disconnect ball may be pumped/dropped through the deployment string 102 to the disconnect seat 15*s*. Milling fluid 141*f* may be pumped or continued to be pumped into the deployment string 102. Pressure exerted on the seated ball may move the actuator sleeve 15 longitudinally against the actuator spring 20, thereby disengaging the actuator sleeve from the dogs 25 and allowing the dog springs to push the dogs radially inward away from the housing 5. The deployment string 102 may then be raised from surface, thereby pulling the housing 5 from the mandrel 10.

Figure 8A:
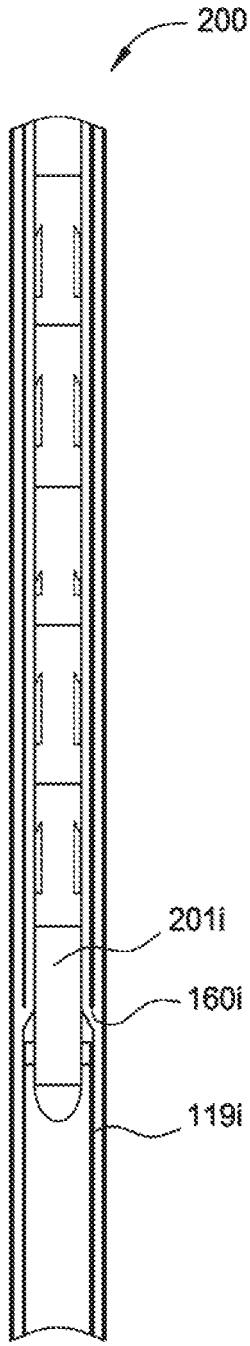
FIGS. 8A-8C illustrate operation of the inner RCW mill.
Figure 8B:
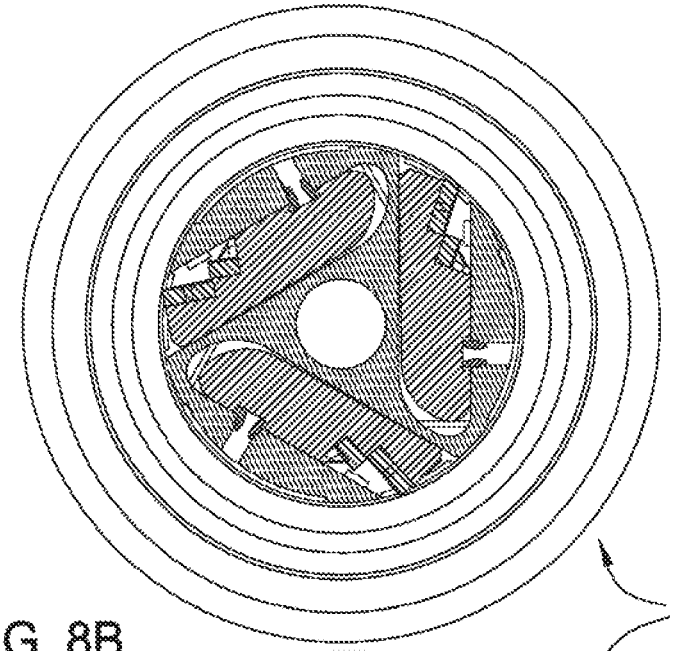
Figure 8C:
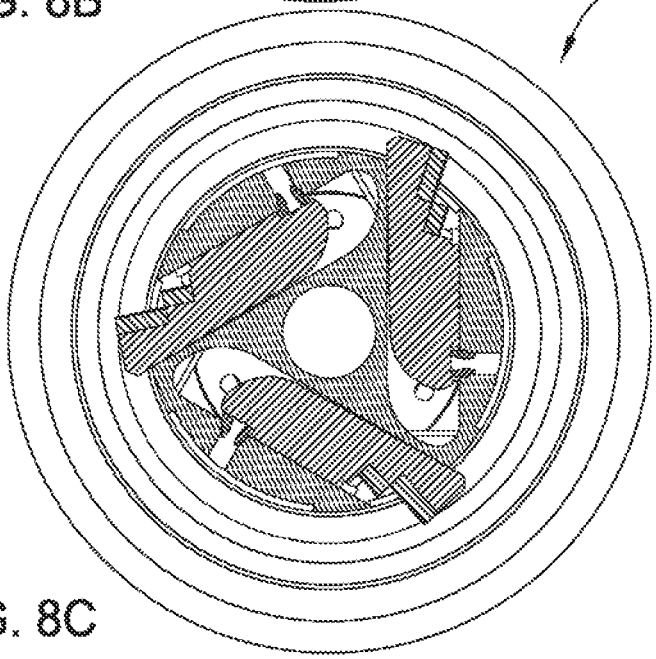
Figure 12:
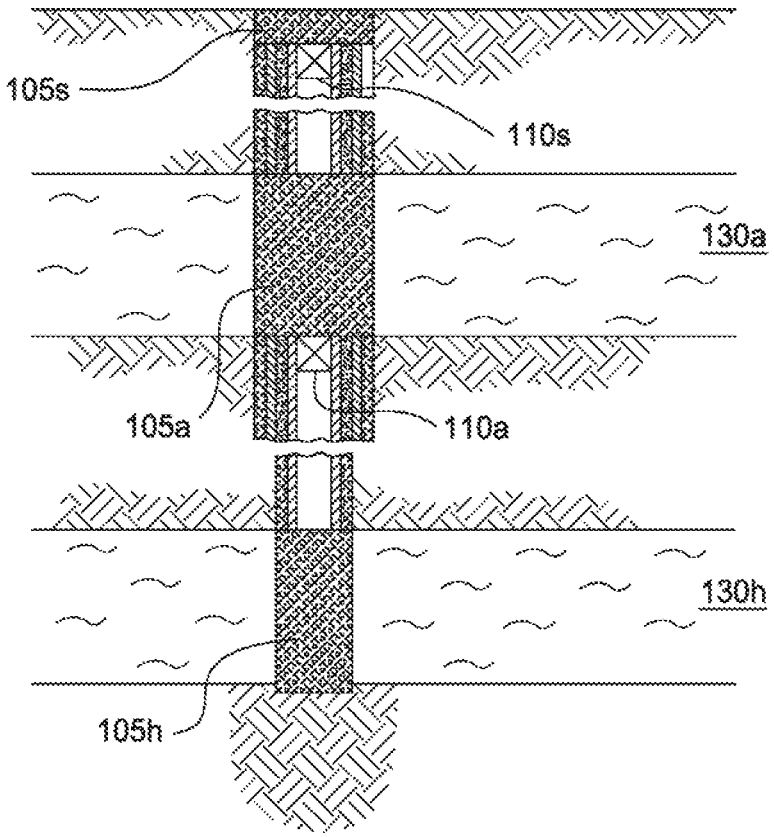
FIG. 12 illustrates the wellbore plugged and abandoned.

FIGS. 8A-8C illustrate operation of the inner RCW mill 201*i*. To begin the P&A operation, a BHA (not shown, see BHA 325 in FIG. 13B) including the disconnect 1, inner section mills 201*i*-203*i*, catcher 50, and shoe 1 may be assembled and deployed into the wellbore 116 using the deployment string 102 through the inner casing 119*i* and to the hydrocarbon formation 130*h*. A section of the inner casing 119*i* lining the hydrocarbon formation 130*h* may be milled and the workstring removed from the wellbore 116. Cement may be pumped into the wellbore, thereby forming a plug 105*h* (FIG. 12). Although a top of the plug 105*h* is shown aligned with a top of the formation 130*h*, the plug may have an excess amount extending above the formation top. The BHA 200 may then be assembled and connected to the deployment string 102. The workstring 100 may then be deployed into the wellbore 116 through the inner casing 119*i*. Alternatively, if the formation 130*a* is hydrocarbon bearing, both formations 130*a,h* may be milled in the same trip or in separate trips as for the aquifer.

During deployment of the workstring 100, milling fluid may be circulated at a flow rate less than a predetermined threshold. The BHA 200 may be deployed to a top of the plug 105*h*. The workstring 100 may then be rotated and the drill bit 75 may be engaged with a top of the plug 105*h* to drill some of the excess and verify integrity of the plug 105*h*. Rotation may be halted and the BHA 200 may be raised to the formation 130*a*. The BHA 200 may be raised so that the inner RCW mill 201*i* is slightly above a top of the formation 130*a* and between couplings of the inner casing 119*i*. Rotation of the workstring 100 may resume and injection of the milling fluid 114*f* may be increased to or greater than the threshold flow rate, thereby causing a substantial pressure differential across the seat 65 and the blade piston 210. The pistons 210, 211*a,b* of the inner RCW mill 201*i* may then push the flow tube 225 upward and the arms 215*r* outward until an outer surface of the trailing portion cutters engage an inner surface of the inner casing string 119*i*. During extension of the inner RCW mill 201*i*, the other mills 201*o*, 202*i,o*, 203*i,o* may be restrained from extension by their respective shear screws 245 and milling fluid may be prevented from discharge through the blade pistons 210 by their respective seats 212*s*.

The inner RCW blade portions 217*r* may engage the inner casing 219*i* and begin to radially cut through the inner casing wall. Milling fluid may be circulated through the workstring 100 and up the workstring-inner casing annulus and a portion of the milling fluid may be diverted into the inner RCW pockets 207*p* through the blade piston passages 210*p*. The BHA 200 may be held longitudinally in place during the radial cut through operation. The workstring torque may be monitored to determine when the inner RCW mill 201*i* has radially cut through the inner casing 119*i* and started the window 160*i* as indicated by a decrease in torque. As shown, the window 160*i* may extend entirely around and through the inner casing 119*i*. As discussed above, the RCW blade portions 217*r* may be specifically configured to radially cut through the respective casings 119*i,o*. The arms 215*r* may extend until engagement with the arm stops 230*i*. Weight may then be set down on the inner RCW mill 201*i*. The inner RCW mill 201*i* may then longitudinally open the window 160*i* while the inner RCW pads (see pads 220 in FIG. 11D) of the body portions 216*r* may engage the inner surface of the inner casing 119*i*, thereby stabilizing the inner RCW mill. Longitudinal advancement of the inner RCW mill 201*i* may continue until the blade portions 217*r* of the inner RCW mill 201*i* are worn away. Again, torque may be monitored to determine when the blade portions 217*r* are exhausted.

Figures 9A, 9B:
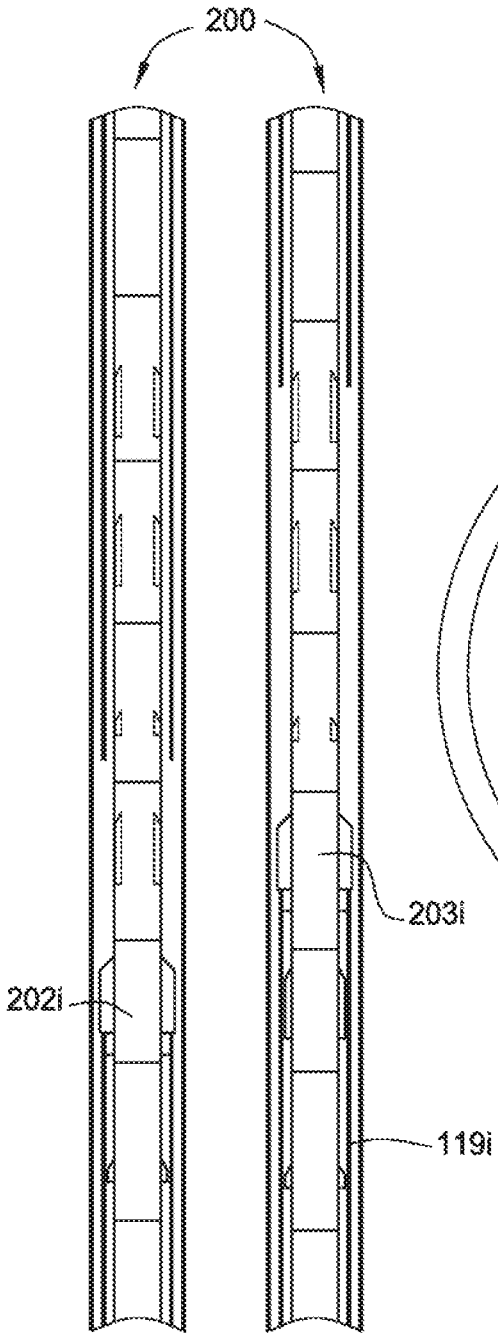
FIGS. 9A-C illustrate operation of the inner second stage and third stage section mills.
Figure 9C:
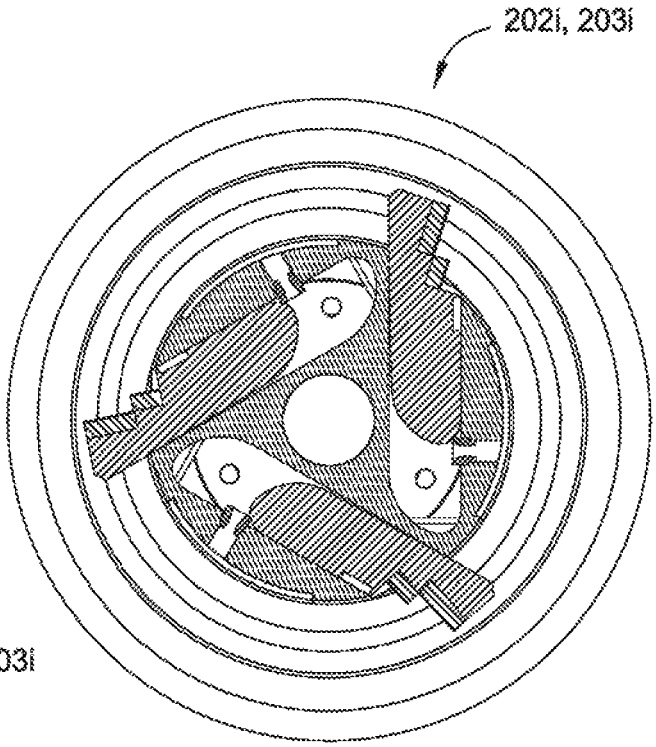

FIGS. 9A-C illustrate operation of the inner second stage 202*i* and third stage 203*i* section mills. Rotation of the workstring 100 may be halted. The second stage inner section mill 202*i* may then be aligned with the inner window 160*i* or may already be aligned with the inner window. The launcher 120 may be operated to deploy ball 120*b*. The ball 120*b* may travel through the deployment string 102 and into the BHA 200 until the ball engages the catcher seat 65. Continued injection of the milling fluid 114*f* into the workstring 100 may increase pressure in the bore above the seated ball 120*b* until a first threshold pressure is reached. Exertion of the first threshold pressure on the second stage pistons 211*a,b* (may or may not include 211*b*) may exert sufficient force to fracture the inner second stage shear screws 245, thereby allowing upward movement of the flow tube 225 until the ports 214*a* are opened and the arms extend and engage the arm stops 230*i*. The third stage section mill 203*i* and the outer mills 2010-203*o* may have a greater number of shear screws 245 so that the first threshold pressure is insufficient to operate them. Fracturing of the shear screws 245 at surface may be detected by a pressure decrease as the ports 214*a* open followed by a pressure increase as the arms 215*s* reach full extension and partially obstruct flow through the pockets 207*p*. Injection of fluid may continue until the bore pressure reaches a second threshold which is greater than the first threshold. The ball 150*b* may be squeezed through the seat 65 at the second threshold pressure and caught in the cage 60.

Before resuming rotation, the BHA 200 may be lowered so that the second stage inner section mill 202*i* engages a lower end of the inner window 160*i* and weight may be set down on the second stage inner section mill to ensure that the arms 215*s* are fully extended. The workstring 100 may then be rotated. As with the inner RCW mill 201*i*, the pads (see pads 220 in FIG. 11D) may engage the inner surface of the inner casing 119*i* and serve to stabilize the section mill 202*i*. The second stage section mill 202*i* may be advanced and may mill the inner casing 119*i* while torque is monitored at surface to determine when the blade portions 217*s* have been exhausted. As discussed above, the exhausted inner RCW mill 201*i* may remain in the extended position to further stabilize the inner section mill 202*i*. Once the second stage inner section mill 202*i* has been exhausted, the larger ball 150*a* may be deployed and pumped through the deployment string 102 until the ball 150*a* lands against the seat 65.

Injection of milling fluid 114*f* may continue until the bore pressure reaches a third threshold pressure which is greater than the second threshold pressure. Exertion of the third threshold pressure on the inner third stage pistons 211*a,b* (may or may not include 211*b*) may exert sufficient force to fracture the inner third stage shear screws 245, thereby allowing upward movement of the flow tube 225 until the ports 214*a* are opened and the arms 215*s* extend and engage the arm stops 230*i*. The outer mills 2010-203*o* may have a greater number of shear screws 245 so that the third threshold pressure is insufficient to operate them. Injection of fluid may continue until the bore pressure reaches a fourth threshold which is greater than the third threshold to squeeze the ball 150*a* into the cage 60. The third stage inner section mill 203*i* may be extended and milling of the inner casing 119*i* may continue while leaving the exhausted second stage inner section mill 202*i* in the extended position for stabilization.

Figure 10A:
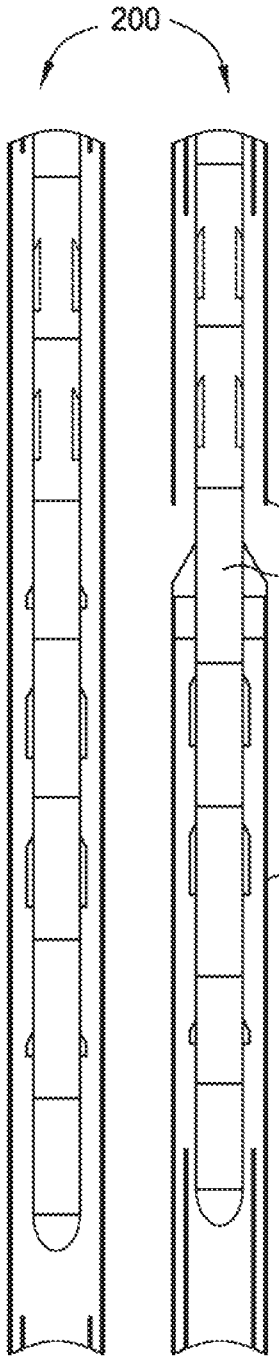
FIG. 10A illustrates raising the BHA in preparation for operation of the outer mills.
Figure 10B:
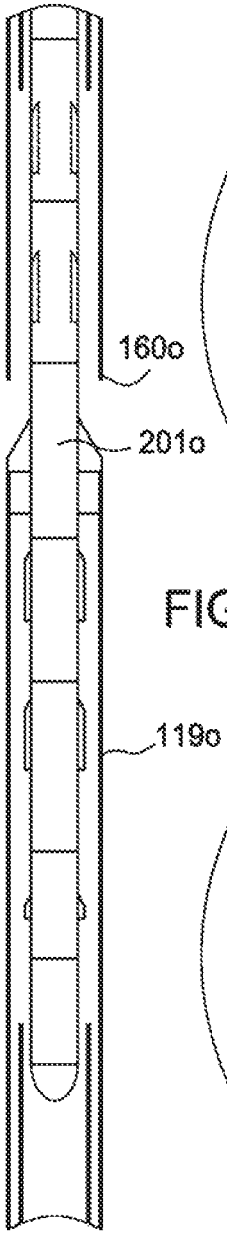
FIGS. 10B-10D illustrate operation of the outer RCW mill.
Figure 10C:
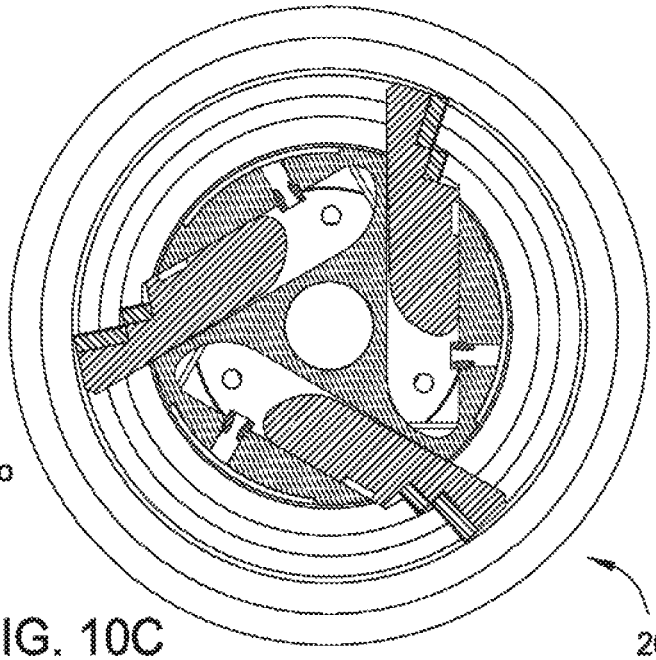
Figure 10D:
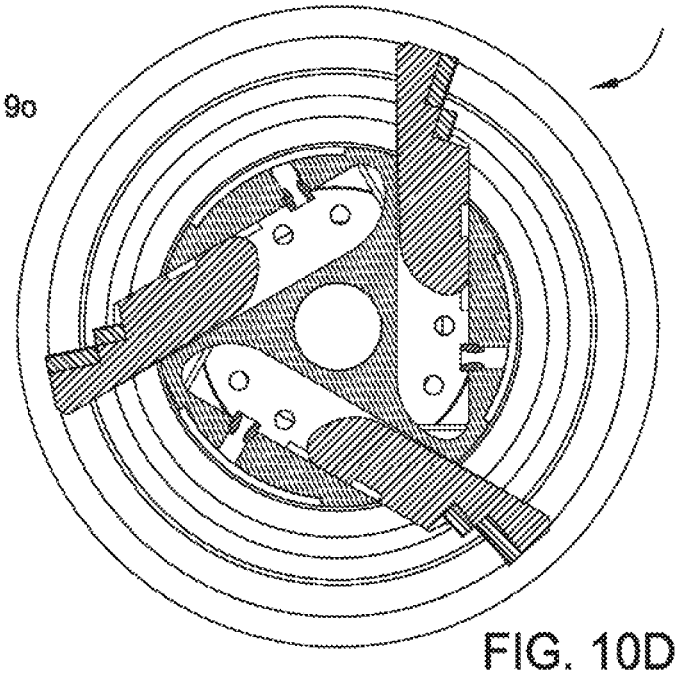

FIG. 10A illustrates raising the BHA 200 in preparation for operation of the outer mills 2010-203*o*. FIGS. 10B-10D illustrate operation of the outer RCW mill 201*o*. FIGS. 11A-11D illustrate operation of the outer second stage 202*o* and third stage 203*o* section mills. Once the desired inner casing section has been milled, the BHA 200 may be raised until the outer RCW mill 2010 is aligned near a top of the inner window 160*i* and between couplings of the outer casing 119*o*. The operation may be repeated with the outer mills 2010-203*o* (except that a ball (not shown, larger than 150a) may be used to operate the outer RCW mill 2010 to form the outer window 1600). Additional balls (not shown), each larger than the last and larger than outer RCW mill ball, may be deployed to operate the outer section mills 202*o*, 203*o*, as discussed above for the inner section mills 202*i*, 203*i*. Once the outer casing section 1190 has been milled, the workstring 100 may be retrieved from the wellbore 116. As discussed above, arms 215*r,s* of the outer mills may (at least partially) retract upon contact with the inner casing 119*i* (upper surface of the inner window 160*i*). The arms of the inner mills may or may not retract as retraction of the inner mill arms may not be necessary to remove the BHA 200 from the wellbore.

FIG. 12 illustrates the wellbore 116 plugged and abandoned. Once the section of the casings 119*i,o* lining the formation 130*a* have been milled, a BHA (not shown) may be connected to the deployment string 102. The BHA may include the bridge plug 110*a*, a setting tool, and a cementing shoe/collar. The BHA may be run into the wellbore 116 using the deployment string 102 to a depth proximately below a bottom of the formation 130*a*. The bridge plug 110*a* may be set using the setting tool by pressurizing the workstring. The setting tool may be released from the bridge plug 110*a*. Cement 105*a* may then be pumped through the workstring to displace wellbore fluid from the formation 130*a*. The workstring may then be removed from the wellbore 116 and the cement 105*a* allowed to cure, thereby forming the cement plug. Alternatively, the bridge plug setting and cementing may be performed in separate trips. A casing cutter (not shown) may then be connected to the workstring. The casing cutter may then be deployed a predetermined depth, such as one hundred feet, in the wellbore. The inner and outer casings may be cut at the predetermined depth and removed from the wellbore. The bridge plug 110*s* may be set proximately below the cut depth and the cement plug 105*s* may be pumped and allowed to cure. The wellbore 116 may then be abandoned.

Additionally, the BHA may further include a fourth stage inner and/or outer section mill to clean any remaining cement and/or debris. The fourth stage inner section mill may be operated after the third stage and before the outer mills and the fourth stage outer section mill may be operated after the third stage mill and before removing the BHA. The fourth stage mills may have slightly modified blade portions to ensure any remaining cement and/or debris is removed.

Alternatively, the inner 201*i*-203*i* and outer mills 2010-203*o* may be deployed in separate trips or the inner or outer mills may be run for a single casing milling operation. Alternatively, instead of a plug and abandon operation, any of the BHAs may be used to form a window for a sidetrack or directional drilling operation. Alternatively, instead of casing strings, any of the BHAs may be used to mill one or more liner strings.

Figure 13A:
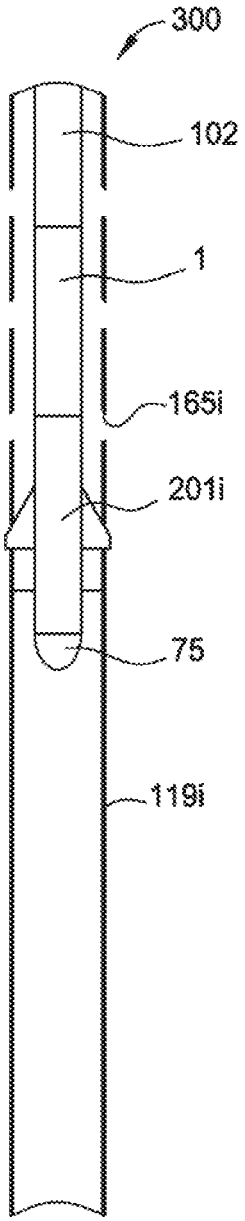
FIG. 13A illustrates a casing recovery operation using one of the RCW mills, according to another embodiment of the present invention.

FIG. 13A illustrates a casing recovery operation using one of the RCW mills 201*i*, according to another embodiment of the present invention. Instead of milling sections of the casing strings for plugs and leaving portions of the casing strings in the wellbore, the RCW mills may be used to remove the casing strings from the wellbore. A BHA 300 may be assembled and connected to the deployment string 102. The BHA 300 may include the disconnect 1, the inner RCW mill 201*i*, and the shoe 75. Additionally, the BHA 300 may include one or more additional inner RCW mills (not shown) so that the additional mills may be activated when or if the initial RCW mill becomes exhausted.

The workstring may then be deployed into the wellbore 116 and operated to radially cut 165*i* through the inner casing string 119*i* at predetermined intervals, such as one hundred to one thousand feet. Once the radial cuts 165*i* have been made along the inner casing string 119*i*, the workstring may be removed from the wellbore 116. A BHA (not shown) including an anchor may be connected to the deployment string 102 and deployed into the wellbore 116. The anchor may be operated to grip the first section of the inner casing string 119*i*. The workstring and first casing string section may then be removed from the wellbore 116. The workstring may then be redeployed to remove the second section of casing 119*i*. This operation may be repeated until the inner casing string 119*i* has been removed from the wellbore. Once the inner casing string 119*i* has been removed, the outer RCW mill 2010 may be deployed and the outer casing string 1190 may be radially cut at the selected intervals and the sections removed from the wellbore 116.

Figure 13B:
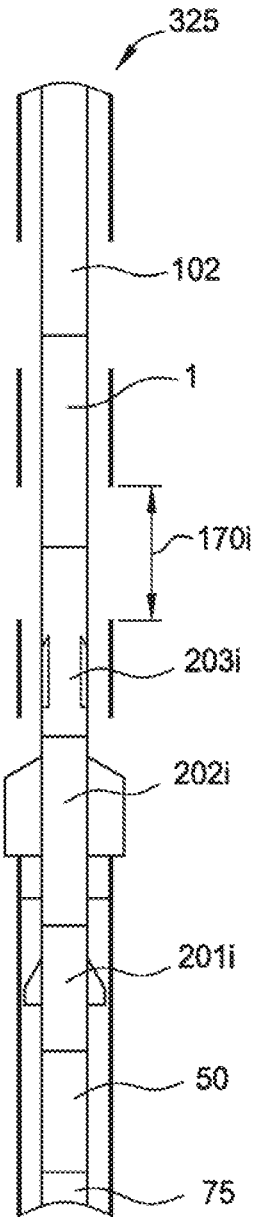
FIGS. 13B and 13C illustrate an abandonment operation using the milling system, according to another embodiment of the present invention.
Figure 13C:
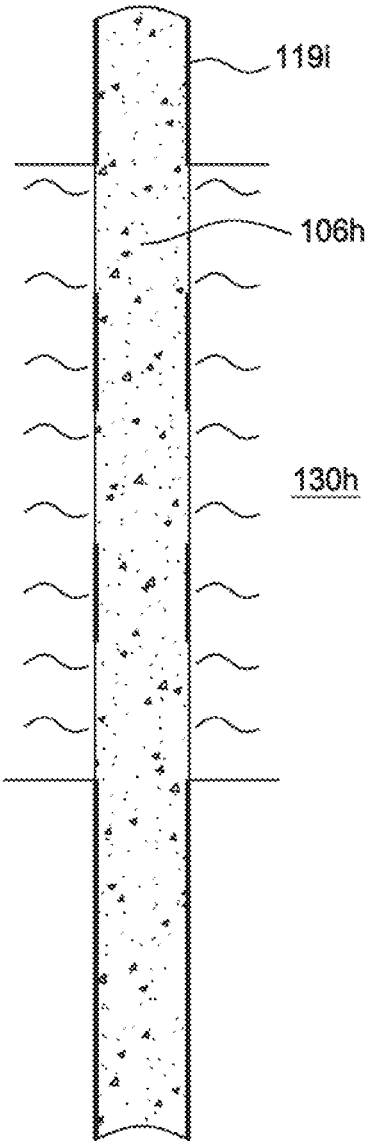

FIGS. 13B and 13C illustrate an abandonment operation using the milling system, according to another embodiment of the present invention. Instead of milling the entire casing string sections lining the formations 130*a,h*, a plurality of mini-sections 170*i* may be milled in the casing strings 119*i,o*. A BHA 325 may be assembled and connected to the deployment string 102. The BHA 325 may include the disconnect 1, the inner RCW mill 201*i*, one or more inner section mills 202*i*, 203*i*, the catcher 50, and the shoe 75. Additionally, the BHA 325 may include one or more additional inner RCW mills (not shown) so that the additional mills may be activated when or if the initial RCW mill becomes exhausted.

The workstring may then be deployed into the wellbore 116. The inner RCW mill 201*i* may be operated to form and open the window for the inner section mills 202*i*, 203*i*. Instead of milling to exhaustion, the inner RCW mill 201*i* may then be retracted and moved to a location of the next mini-section 170*i* and operated to form and open the window for the section mills 202*i*, 203*i*. This operation may be repeated until windows corresponding to all of the mini-sections 170*i* have been formed and opened. The BHA 325 may then be moved to align the section mill 202*i* with a first one of the windows. The section mill 202*i* may then be operated to extend the window into a mini-section 170*i*. The section mill 202*i* may then be retracted and moved to the next window. This process may repeated until all of the mini-sections 170*i* are formed. The workstring may then be removed from the wellbore 116 and the cement plug 106*h* pumped and allowed to cure. The BHA 200 may then be deployed and a similar mini-section operation performed for the casings lining the formation 130*a*.

Figures 14A, 14B, 14C:
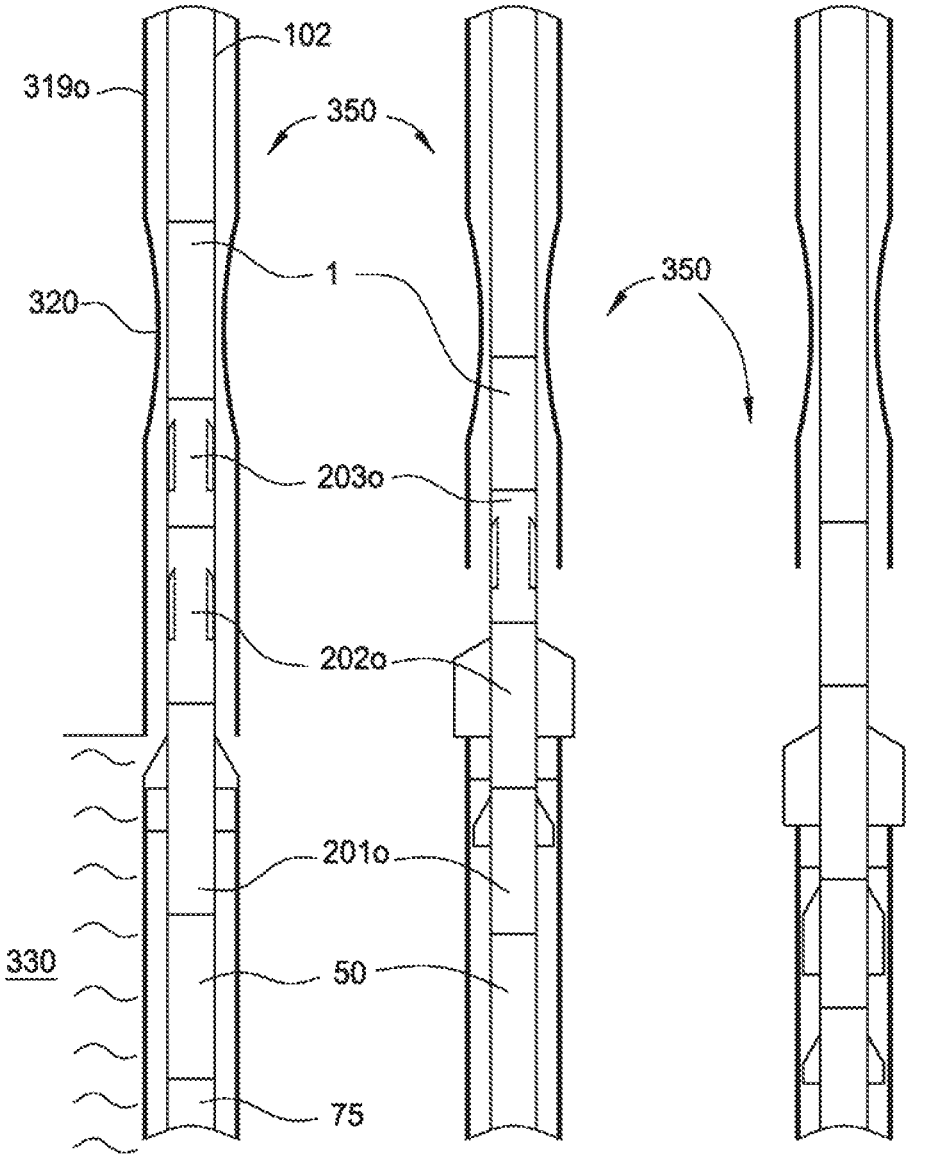
FIGS. 14A-14C illustrate section milling of a damaged and/or partially collapsed casing or liner string, according to another embodiment of the present invention.

FIGS. 14A-14C illustrate section milling of a damaged and/or partially collapsed casing 3190 or liner string, according to another embodiment of the present invention. In this embodiment, the formation 330 to be plugged is lined with a casing string 3190 having a size corresponding to the outer casing string 1190 and a collapsed section 320 above the formation 330 to be plugged. Due to the great extension capability of the outer section mills 2010-203*o* (discussed above), the casing 3190 lining the formation 330 may be milled in spite of the collapsed portion 320. A BHA 350 may be assembled and connected to the deployment string 102. The BHA 350 may include the disconnect 1, the outer RCW mill 201*o*, one or more outer section mills 202*o*, 203*o*, the catcher 50, and the shoe 75. The workstring may then be deployed into the wellbore 116 to the formation 330 through the casing string 3190 (including the damaged portion 320). The outer RCW mill 2010 may be operated to form and open the window for the outer section mills 202*o*, 203*o*. The outer section mills 202*o*, 203*o* may then be operated to mill the section of casing 3190 lining the formation 330. The cement plug (not shown) may then be pumped and allowed to cure. The shear pins 245 and partition seat 212*s* may or may not be omitted from the outer RCW mill 2010 in this alternative.

Figure 15A:
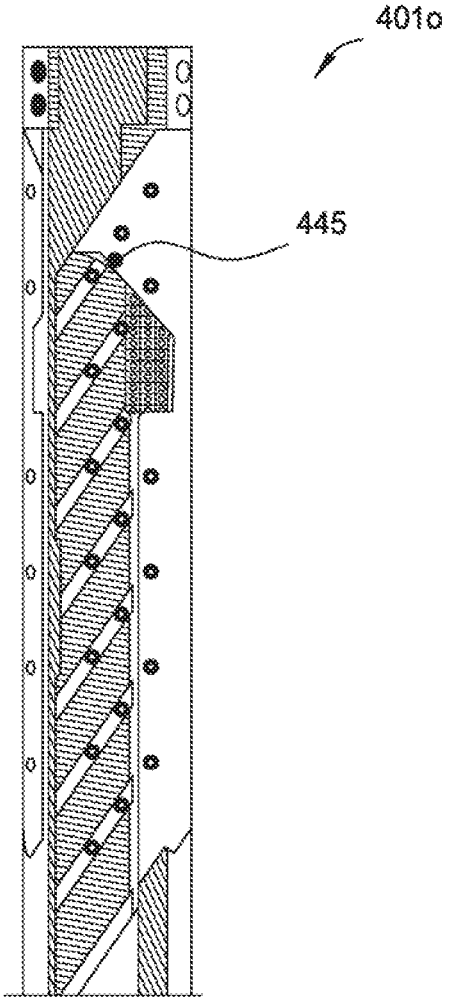
FIG. 15A is an offset section of an arm of an outer RCW mill, according to another embodiment of the present invention.

FIG. 15A is an offset section of an arm of an outer RCW mill 401*o*, according to another embodiment of the present invention. The outer RCW mill 4010 may be similar or identical to the outer RCW mill 2010 except that a frangible fastener 445, such as a shear pin or shear screw, has been added in each pocket 207*p* to facilitate retaining of the arms 215*r* in the retracted position. The frangible fasteners 445 may also be added to the section mills 202*i,o*, 203*i,o* and/or the inner RCW mill 201*i*.

Figure 15B:
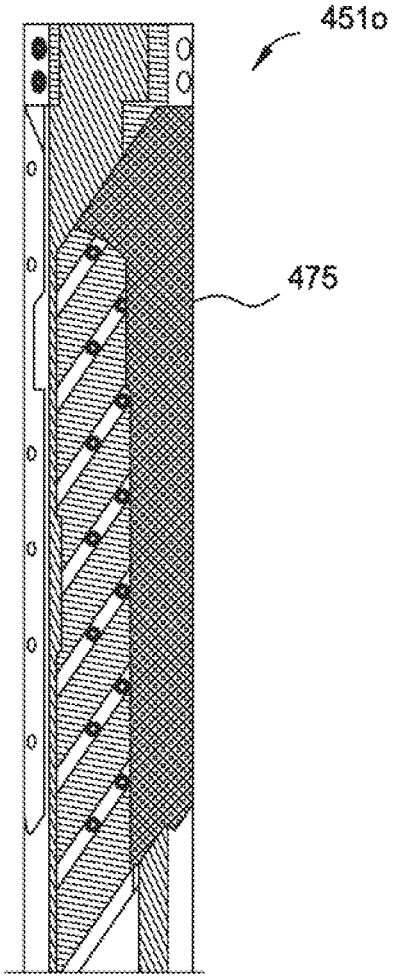
FIG. 15B is an offset section of an arm of an outer RCW mill, according to another embodiment of the present invention.

FIG. 15B is an offset section of an arm of an outer RCW mill 451*o*, according to another embodiment of the present invention. The outer RCW mill 4510 may be similar or identical to the outer RCW mill 2010 except that pocket cover 475 has been added to each pocket 207*p* to prevent accumulation of cuttings within the pockets while the inner mills 201*i*-203*i* are milling. Accumulation of cuttings in the pockets 207*p* may obstruct extension of the arms. The cover 475 may be a foamed polymer, such as polyurethane, and may be sprayed in the pocket after the arms have been inserted into the pockets and the arm stops have been connected. An insert (not shown) may be inserted into each pocket before spraying to prevent entry of the foam into a space of the pocket below the arm. Alternatively, the cover 475 may be made from a high temperature hot melt adhesive, such as a thermoplastic (i.e., polyamide or polyester). As with the spray foam, the molten adhesive may be applied after the arms have been inserted into the pockets and the arm stops have been connected using a conventional manual hot melt glue gun or a gas driven hot melt glue gun. The covers 475 may be jettisoned when the arms are extended or quickly disintegrated during milling. Alternatively, the cover 475 may be a polymer molded to fit each arm and be inserted into the pocket after the arms but before the arm stops and have a lip extending underneath an edge of the pocket and underneath the arm stops for connection. The arm covers 475 may also be added to the section mills 202*i,o*, 203*i,o* and/or the inner RCW mill 201*i*.

Figure 16A:
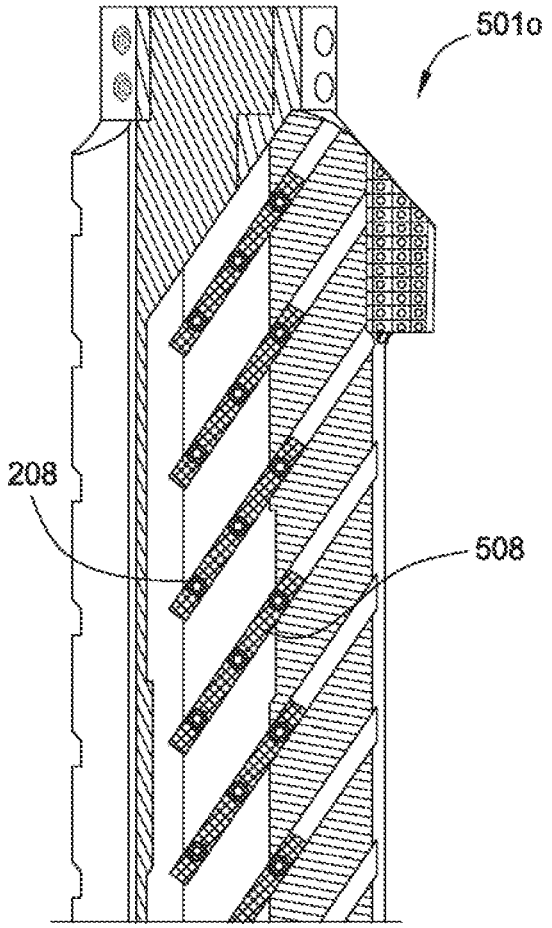
FIG. 16A is an offset section of an arm of an outer RCW mill, according to another embodiment of the present invention.

FIG. 16A is an offset section of an arm of an outer RCW mill 501*o*, according to another embodiment of the present invention. FIG. 16B illustrates a debris barrier 508 of the mill. The outer RCW mill 5010 may be similar or identical to the outer RCW mill 2010 except that a debris barrier 508 has been added to each pocket 207*p* for each set of guide pins 208 to prevent accumulation of cuttings within the pockets of the outer RCW mill 5010 while the outer mills are milling. Accumulation of cuttings in the pockets may obstruct retraction of the arms. Each debris barrier 508 may be a strip of material, such as a polymer, and may be fastened to the housing using the guide pins 208. Each debris barrier 508 may have a recess formed in a surface thereof for accommodating a respective guide pin. The polymer may have lubricative properties, such as polytetrafluoroethylene (PTFE), so as not to obstruct movement of the arms. Each strip may be sized to have a width forming a line fit with the respective groove 216*g*, such as having an allowance of less than or equal to one, three-fourths, one-half, or one-fourth percent of the groove width (and greater than or equal to zero). Alternatively, each strip width may be sized to form an interference fit with the respective groove. Each strip may at least partially extend into the respective groove when the arms are in the extended position.

Figure 16C:
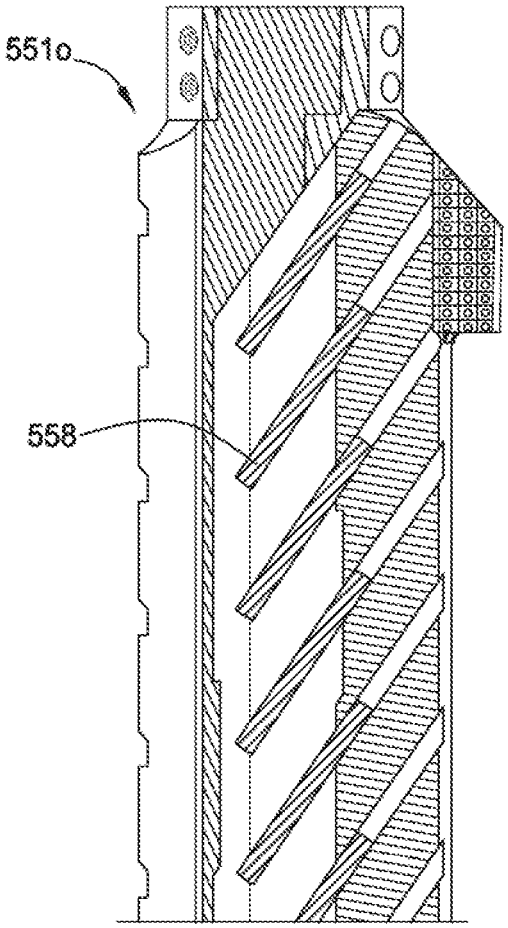
FIG. 16C is an offset section of an arm of an outer RCW mill, according to another embodiment of the present invention.
Figure 16B:
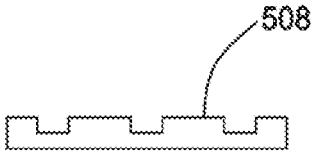
FIG. 16B illustrates a debris barrier of the mill.
Figure 16D:
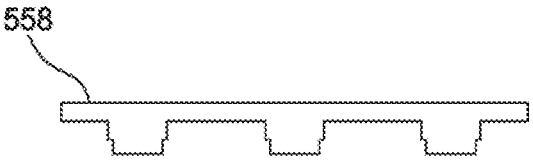
FIG. 16D illustrates a debris barrier of the mill.

FIG. 16C is an offset section of an outer RCW mill 551*o*, according to another embodiment of the present invention. FIG. 16D illustrates a debris barrier 558 of the mill. The outer RCW mill 5510 may be similar or identical to the outer RCW mill 2010 except that a debris barrier 558 has been added to each pocket 207*p* to replace each set of the guide pins 208 and prevent accumulation of cuttings within the pockets of the outer RCW mill while the outer mills are milling. Accumulation of cuttings in the pockets may obstruct retraction of the arms. Each debris barrier 558 may be a strip of plain bearing material and may have rail portion for guiding the arms and a fastener portion for connection to the housing. The pin portions may be pressed or bonded into respective housing openings. The plain bearing material may be a metal or alloy, such as Babbitt metal, brass, bronze, or copper alloy (i.e., Beryllium copper). Alternatively, the debris barrier may be made from steel and the rail portion coated with the plain bearing material or PTFE. Each rail portion may be sized to have a width forming a line fit with the respective groove 216*g*, such as having an allowance of less than or equal to one, three-fourths, one-half, or one-fourth percent of the groove width (and greater than or equal to zero). Alternatively, each rail portion width may be sized to form an interference fit with the respective groove. Each rail portion may at least partially extend into the respective groove when the arms are in the extended position.

Figure 17A:
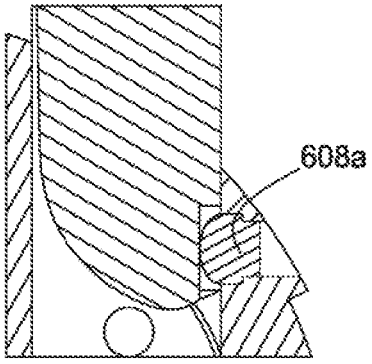
FIGS. 17A-17C illustrate guides for the mills, according to other embodiments of the present invention.
Figure 17B:
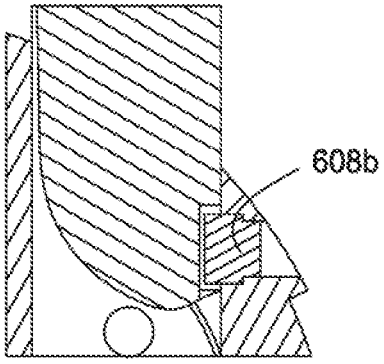
Figure 17C:
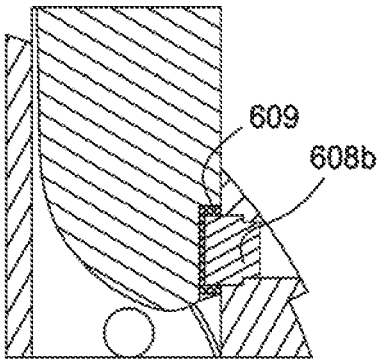

FIGS. 17A-17C illustrate guides 608*a,b* for the mills, according to other embodiments of the present invention. Instead of the hollow guide pins 208, the solid guide pin 608*a* may be used. The guide pin 608*a* may have a round head. Instead of the hollow guide pins 208, the solid guide pin 608*b* may be used. The guide pin 608*b* may have a flat head. Additionally, each guide pin 608*b* may be coated 609 with the plain bearing material or PTFE to provide a line fit or interference fit as discussed above to obstruct or prevent cuttings from entering the pockets and obstructing retraction of the arms.

In another embodiment (not shown) discussed and illustrated at FIGS. 1A, 2A, 3-3D, and 4 of the '627 provisional, each of the mills may include a control module and the BHA may further include a telemetry sub for receiving instruction signals from the surface, thereby obviating the shear screws 245. The inner RCW mill may or may not have a control module. Each control module may include a hydraulic or mechanical lock for restraining movement of the flow tube until the control module receives the instruction signal for releasing the flow tube from surface. The telemetry sub may include a receiver for receiving the instruction signal from surface and a relay for transmitting the instruction signal to the individual control modules. The instruction signal may sent by modulating rotation of the workstring, modulating injection rate of the milling fluid, modulating pressure of the milling fluid (mud pulse), electromagnetic telemetry, transverse electromagnetic telemetry, radio frequency identification (RFID) tag, or conductors extending along the deployment string. The telemetry sub may further include a transmitter for transmitting acknowledgment of the instruction signal, such as a mud pulser, electromagnetic or transverse electromagnetic transmitter, or RFID tag launcher. Each control module may further include a position sensor operable to monitor movement of the flow tube and the control module may transmit measurements of the position sensor to the telemetry sub for relay to the surface.

While the foregoing is directed to embodiments of the present invention, other and further embodiments of the invention may be devised without departing from the basic scope thereof, and the scope thereof is determined by the claims that follow.

The invention claimed is:

1. A milling tool comprising:
a tubular housing having a longitudinal axis;
a plurality of circumferentially aligned openings formed in the housing;
a plurality of arms, each arm:
located within a corresponding one of the plurality of openings,
having an arm length oriented substantially parallel to the longitudinal axis, and
movable laterally and longitudinally with respect to the corresponding opening between retracted and extended positions while the arm length is maintained substantially parallel to the longitudinal axis; and
a plurality of blades, each blade associated with a corresponding one of the plurality of arms;
wherein:
the milling tool is movable between a deployment configuration and a casing cutting configuration, and
when the milling tool is in the casing cutting configuration, the arms are in the extended position and a lateral blade sweep dimension is more than fifty percent greater than an outer diameter of the housing.

2. The milling tool of claim 1, wherein when the milling tool is in the casing cutting configuration, the lateral blade sweep dimension is more than sixty-seven percent greater than a nominal outer diameter of the housing.

3. The milling tool of claim 1, wherein when the milling tool is in the casing cutting configuration, the lateral blade sweep dimension is more than seventy-five percent greater than a nominal outer diameter of the housing.

4. The milling tool of claim 1, wherein when the milling tool is in the casing cutting configuration, the lateral blade sweep dimension is more than eighty-five percent greater than a nominal outer diameter of the housing.

5. The milling tool of claim 1, wherein each opening is eccentrically arranged relative to the housing.

6. The milling tool of claim 1, further comprising each arm having a single blade.

7. The milling tool of claim 1, wherein each blade has cutting elements disposed on a side of the blade.

8. The milling tool of claim 1, further comprising each arm having an outer surface including a material selected from the group consisting of hard material and super-hard material.

9. A milling tool comprising:
a tubular housing having an outer surface, an upper end, a lower end, and a central flow bore continuous from the upper end to the lower end;
a plurality of circumferentially aligned openings formed in the outer surface;
a plurality of arms, each arm:
located within a corresponding one of the plurality of openings,
having a body portion between a first end and a second end, the body portion including an actuation profile comprising inclined grooves, and
movable with respect to the corresponding opening between retracted and extended positions, wherein when in the retracted position, the first and second ends are closer to the central flow bore than when in the extended position; and
a plurality of blades, each blade associated with a corresponding one of the plurality of arms;
wherein:
the milling tool is movable between a deployment configuration and a casing cutting configuration, and
when the milling tool is in the casing cutting configuration, the arms are in the extended position and a lateral blade sweep dimension is more than fifty percent greater than a nominal outer diameter of the housing.

10. The milling tool of claim 9, wherein when the milling tool is in the casing cutting configuration, the lateral blade sweep dimension is more than sixty-seven percent greater than a nominal outer diameter of the housing.

11. The milling tool of claim 9, wherein when the milling tool is in the casing cutting configuration, the lateral blade sweep dimension is more than seventy-five percent greater than a nominal outer diameter of the housing.

12. The milling tool of claim 9, wherein when the milling tool is in the casing cutting configuration, the lateral blade sweep dimension is more than eighty-five percent greater than a nominal outer diameter of the housing.

13. The milling tool of claim 9, wherein each opening defines a pocket.

14. The milling tool of claim 13, wherein each pocket is eccentrically arranged relative to the housing.

15. The milling tool of claim 9, further comprising each arm having a single blade.

16. The milling tool of claim 9, further comprising each arm having an outer surface including a material selected from the group consisting of hard material and super-hard material.

* * * * *